US010128581B2

(12) United States Patent
Seshimo et al.

(10) Patent No.: US 10,128,581 B2
(45) Date of Patent: Nov. 13, 2018

(54) CRIMP TERMINAL

(71) Applicant: FUJIKURA LTD., Tokyo (JP)

(72) Inventors: Yuya Seshimo, Sakura (JP); Shigeru Ishikawa, Tokyo (JP); Ichiro Terunuma, Tokyo (JP)

(73) Assignee: Fujikura Ltd., Tokyo (JP)

( * ) Notice: Subject to any disclaimer, the term of this patent is extended or adjusted under 35 U.S.C. 154(b) by 0 days.

(21) Appl. No.: 15/319,212

(22) PCT Filed: Jun. 18, 2015

(86) PCT No.: PCT/JP2015/067633
§ 371 (c)(1),
(2) Date: Dec. 15, 2016

(87) PCT Pub. No.: WO2015/194640
PCT Pub. Date: Dec. 23, 2015

(65) Prior Publication Data

US 2017/0141488 A1 May 18, 2017

(30) Foreign Application Priority Data

Jun. 19, 2014 (JP) ..... 2014-126411
Nov. 27, 2014 (JP) ..... 2014-239494

(51) Int. Cl.
*H01R 4/18* (2006.01)
*H01R 4/20* (2006.01)

(52) U.S. Cl.
CPC ..... *H01R 4/188* (2013.01); *H01R 4/203* (2013.01)

(58) Field of Classification Search
CPC ..... H01R 4/203; H01R 4/188
See application file for complete search history.

(56) References Cited

U.S. PATENT DOCUMENTS 3,514,528 A * 5/1970 Ray ..... H01R 4/2495 174/84 C
3,662,089 A * 5/1972 Harding ..... H01R 4/2495 174/84 C
3,902,004 A * 8/1975 Harding ..... H01R 4/2495 174/84 C
4,220,387 A * 9/1980 Biche ..... A61B 5/0416 439/445

(Continued)

FOREIGN PATENT DOCUMENTS

JP 51-067321 U1 5/1976
JP 5-152011 A 6/1993

(Continued)

OTHER PUBLICATIONS

International Search Report of PCT/JP2015/067633 dated Oct. 13, 2015 [PCT/ISA/210].

(Continued)

*Primary Examiner* — James Harvey
(74) *Attorney, Agent, or Firm* — Westerman, Hattori, Daniels & Adrian, LLP

(57) ABSTRACT

A crimp terminal (1) includes a barrel (13) on which a recessed serration (14) is formed, the barrel is to be bent and crimped to a conductor portion (21) of a wire (2), and the shape of an outer edge of the serration (14) is formed so that arcs (A1 to A4) each of which is convex outward continue to each other.

17 Claims, 16 Drawing Sheets

(56) References Cited

U.S. PATENT DOCUMENTS

| | | | | |
|---|---|---|---|---|
| 4,263,474 | A * | 4/1981 | Tennant | H01R 12/67 174/84 C |
| 5,316,506 | A | 5/1994 | Ito | |
| 5,370,560 | A | 12/1994 | Ito | |
| 6,056,605 | A | 5/2000 | Nguyen et al. | |
| 7,722,416 | B2 * | 5/2010 | Gump | H01R 4/188 439/879 |
| 8,337,262 | B2 * | 12/2012 | Ono | H01R 4/185 439/877 |
| 9,673,578 | B1 * | 6/2017 | Lane | H01R 4/183 |
| 9,711,873 | B1 * | 7/2017 | Tanaka | H01R 4/188 |
| 2013/0115830 | A1 * | 5/2013 | Seifert | H01R 4/185 439/888 |
| 2013/0130566 | A1 | 5/2013 | Onuma et al. | |
| 2013/0130569 | A1 * | 5/2013 | Sato | H01R 4/206 439/882 |
| 2013/0137315 | A1 * | 5/2013 | Onuma | B21J 5/12 439/877 |
| 2013/0143454 | A1 | 6/2013 | Onuma et al. | |
| 2014/0004759 | A1 * | 1/2014 | Kondou | H01R 4/185 439/878 |
| 2014/0213123 | A1 * | 7/2014 | Ito | H01R 4/188 439/877 |
| 2015/0072573 | A1 * | 3/2015 | Kawamura | H01R 4/203 439/867 |
| 2015/0147923 | A1 * | 5/2015 | Todo | H01R 4/62 439/882 |
| 2015/0155638 | A1 * | 6/2015 | Nagahashi | H01R 4/203 174/74 R |
| 2015/0244084 | A1 * | 8/2015 | Aizawa | H01R 4/185 439/878 |
| 2017/0141488 | A1 * | 5/2017 | Seshimo | H01R 4/188 |
| 2017/0179615 | A1 * | 6/2017 | Shinohara | H01R 4/185 |

FOREIGN PATENT DOCUMENTS

| | | | |
|---|---|---|---|
| JP | 11-515137 | A | 12/1999 |
| JP | 2009-193890 | A | 8/2009 |
| JP | 2010-198789 | A | 9/2010 |
| JP | 2011-81911 | A | 4/2011 |
| JP | 2012-038453 | A | 2/2012 |
| JP | 2012-038493 | A | 2/2012 |

OTHER PUBLICATIONS

Office Action dated Aug. 1, 2017, issued in counterpart Japanese Application No. 2014-126411, with English translation (4 pages).
Office Action dated Dec. 26, 2017, issued in counterpart Japanese Application No. 2014-126411, with English machine translation. (6 pages).
Office Action dated Apr. 17, 2018, issued in counterpart Japanese application No. 2014-239494, with English machine translation. (6 pages).

* cited by examiner

CRIMP TERMINAL

CROSS REFERENCE TO RELATED APPLICATIONS

This application is a National Stage of International Application No. PCT/JP2015/067633, filed Jun. 18, 2015, claiming priorities based on Japanese Patent Application Nos. 2014-126411, filed Jun. 19, 2014 and 2014-239494, filed Nov. 27, 2014, the contents of all of which are incorporated herein by reference in their entirety.

TECHNICAL FIELD

The present invention relates to a crimp terminal.

BACKGROUND ART

It is known that the crimp terminal has a conductor crimp portion which includes a serration formed by cylindrical recesses on the inner surface and the conductor crimp portion is crimped to an end of a conductor of a wire so as to be connected to the conductor of the wire (for example, see Patent Document 1).

CITATION LIST

Patent Document

Patent Document 1: JP 2012-38453 A

SUMMARY OF THE INVENTION

Problem to Be Solved By the Invention

Edge portions of the recesses forming the serration break an oxide film formed on the surface of the conductor of the wire, so that the connection between the conductor crimp portion and the conductor of the wire is achieved. In this regard, since the shape of the outer edge of the recess forming the serration is a circular shape in the above-mentioned crimp terminal, the outer edge of the serration is short with respect to an area which is occupied by the serration. In order to improve reliability in the connection between the conductor crimp portion and the conductor of the wire, it is necessary to increase the area of the recess by an increase in the diameter of the cylindrical recess in the above-mentioned crimp terminal. However, there is a problem that energy required for forming the serration is increased, if the area of the recess is increased by an increase in the diameter of the cylindrical recess.

An object of the invention is to provide a crimp terminal which can improve reliability in connection between the crimp terminal and a conductor portion of a wire while suppressing an increase in energy required for the forming of serrations.

Means for Solving Problem

[1] A crimp terminal according to the invention includes a barrel on which a recessed serration is formed, the barrel is to be bent and crimped to a conductor portion of a wire, and the shape of an outer edge of the serration is formed so that arcs each of which is convex outward continue to each other.

[2] In the invention, the shape of the outer edge may include a round shape which is formed at a connected portion between the adjacent arcs.

[3] In the invention, a smallest circle which is circumscribed about the shape of the outer edge may be a true circle.

[4] In the invention, the number of the arcs which form the shape of the outer edge may be 3, 4, or 6.

[5] A crimp terminal according to the invention includes a barrel on which a serration is formed, the barrel is to be bent and crimped to a conductor portion of a wire, and the serration includes: a recess which has a circular contour in a plan view; and a protrusion which is provided in the recess.

[6] In the invention, the protrusion may be connected to the contour of the recess in a plan view.

[7] In the invention, the protrusion may include a strip shape which linearly extends and passes through a center of the recess in a plan view.

[8] In the invention, the protrusion may include first and second strip shapes which linearly extend and are substantially orthogonal to each other at a center of the recess in a plan view, both end portions of the first strip shape in an extending direction of the first strip shape may be connected to the contour of the recess, and both end portions of the second strip shape in an extending direction of the second strip shape may be connected to the contour of the recess.

[9] In the invention, the following Equation (1) may be satisfied.

$$\alpha=\beta=45^\circ \quad (1)$$

Here, in the Equation (1), $\alpha$ denotes an angle between an extending direction of the conductor portion and an extending direction of the first strip shape, and $\beta$ denotes an angle between the extending direction of the conductor portion and the extending direction of the second strip shape.

[10] In the crimp terminal according to the invention, the crimp terminal includes the barrel on which serrations each of which is the serration are formed, the serrations may be disposed along the extending direction of the first strip shape or the extending direction of the second strip shape.

[11] In the invention, the protrusion may include a strip shape which linearly extends and passes through a center of the recess in a plan view, and both end portions of the strip shape in an extending direction of the strip shape may be connected to the contour of the recess.

[12] In the invention, the protrusion may include first to third strip shapes each of which linearly extends to a center of the recess from the contour of the recess in a plan view, the first to third strip shapes may be connected to each other at the center of the recess, and the following Equation (2) may be satisfied.

$$\gamma=\delta=\varepsilon \quad (2)$$

Here, in the Equation (2), $\gamma$ denotes an angle between an extending direction of the first strip shape and an extending direction of the second strip shape, $\delta$ denotes an angle between the extending direction of the second strip shape and an extending direction of the third strip shape, and $\varepsilon$ denotes an angle between the extending direction of the third strip shape and the extending direction of the first strip shape.

[13] In the invention, a round shape may be formed at an intersection between the protrusion and the contour of the recess.

Effect of the Invention

According to the invention, the shape of the outer edge of the serration is formed so that arcs each of which is convex outward continue to each other. Accordingly, the outer edge of the serration can be made long with respect to the area which is occupied by the serration. Accordingly, it is possible to improve reliability in the connection between the crimp terminal and the conductor portion of the wire while an increase in energy required for forming the serration is suppressed.

According to the invention, the protrusion is provided in the recess of the serration. Accordingly, the edge portion formed within the contour of the recess can be made long. For this reason, it is possible to improve reliability in the connection between the crimp terminal and the conductor portion of the wire while an increase in energy required for forming the serration is suppressed.

BRIEF DESCRIPTION OF DRAWINGS

FIG. 16(A) is a plan view, and FIG. 16(B) is a diagram illustrating a cross-section taken along line XVIB-XVIB of FIG. 16(A).

MODE(S) FOR CARRYING OUT THE INVENTION

A first embodiment of the invention will be described below with reference to the drawings.

Figure 1:
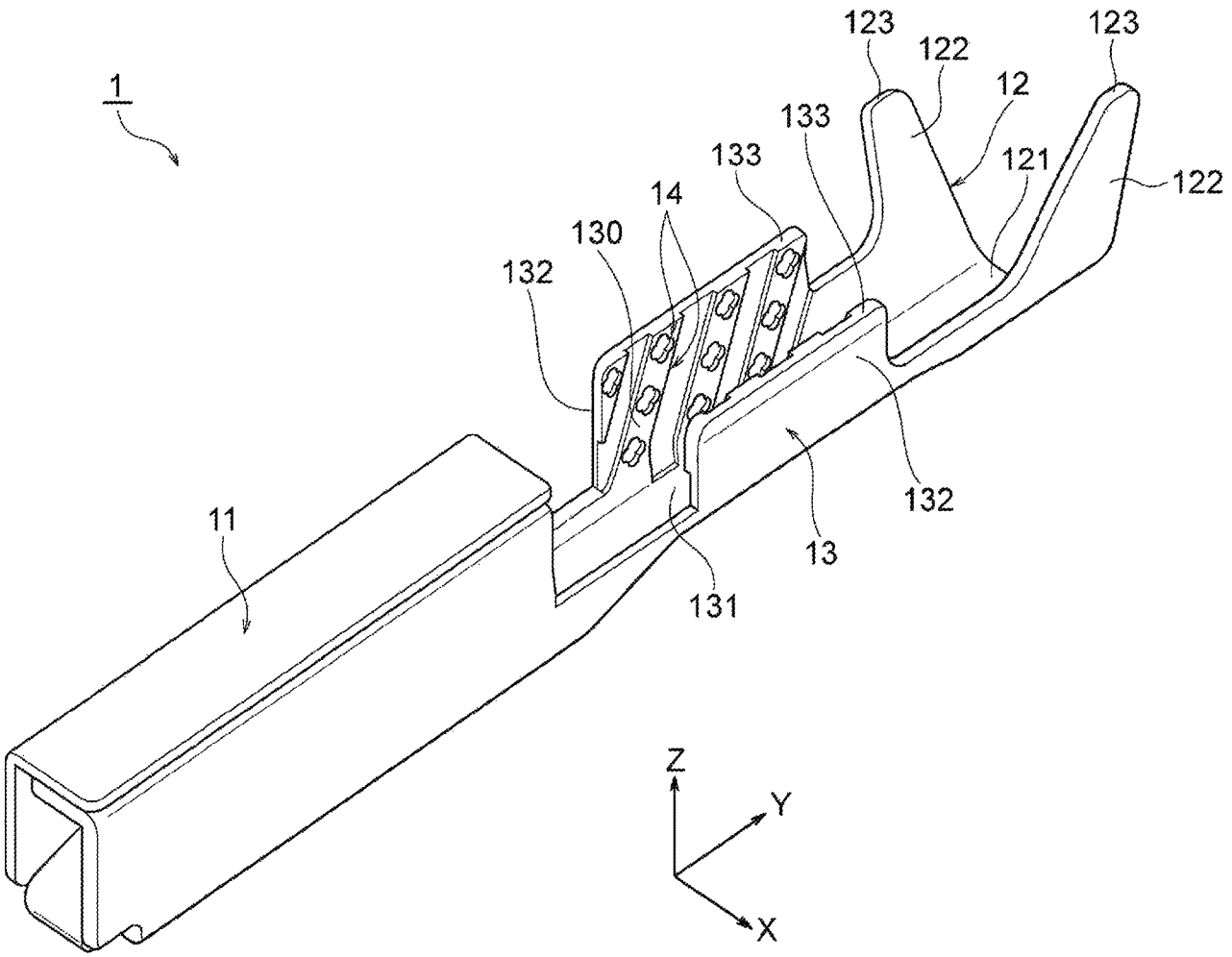
FIG. 1 is a perspective view of a crimp terminal in a first embodiment of the invention.
Figure 2:
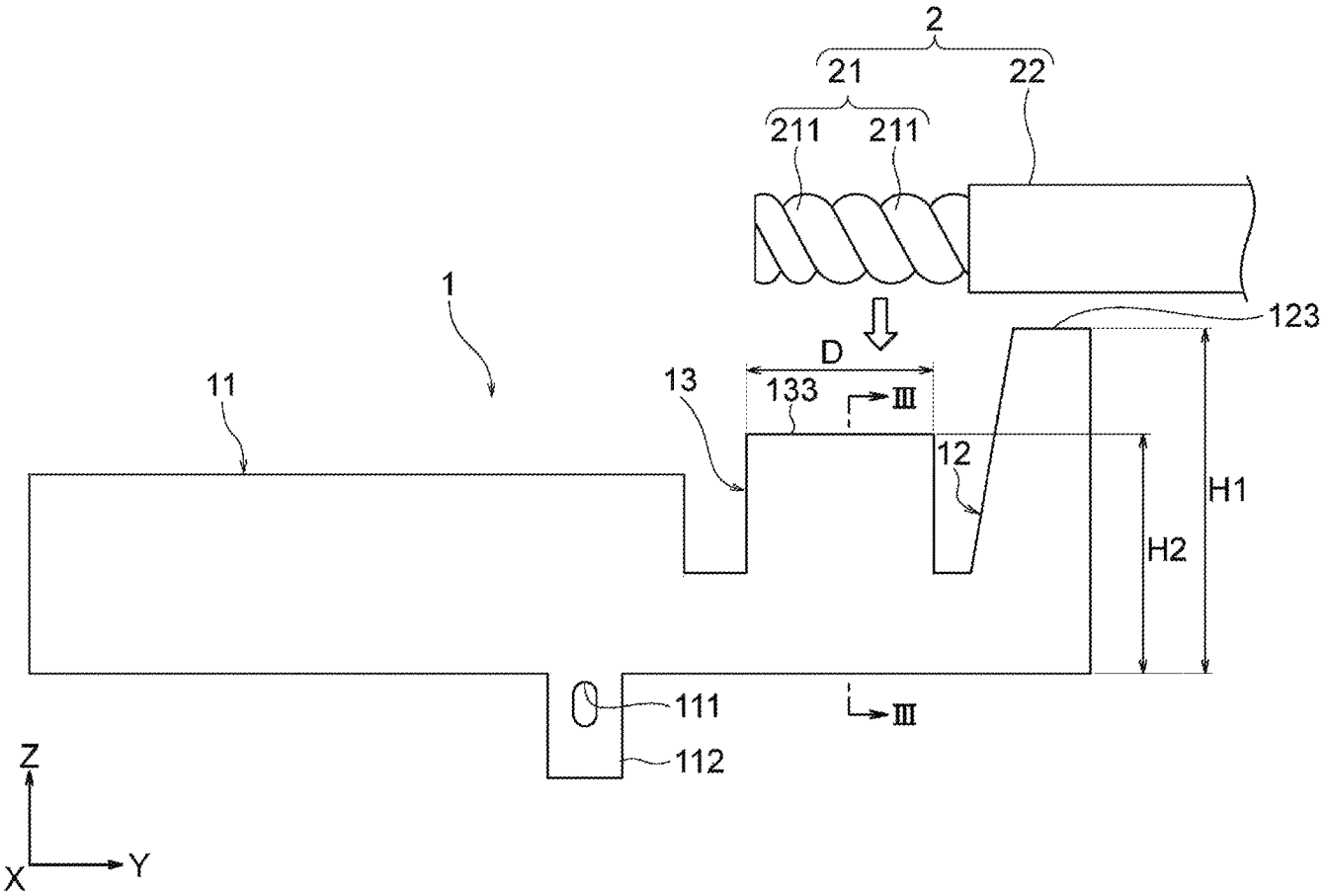
FIG. 2 is a side view of the crimp terminal and a wire in the first embodiment of the invention.
Figure 3:
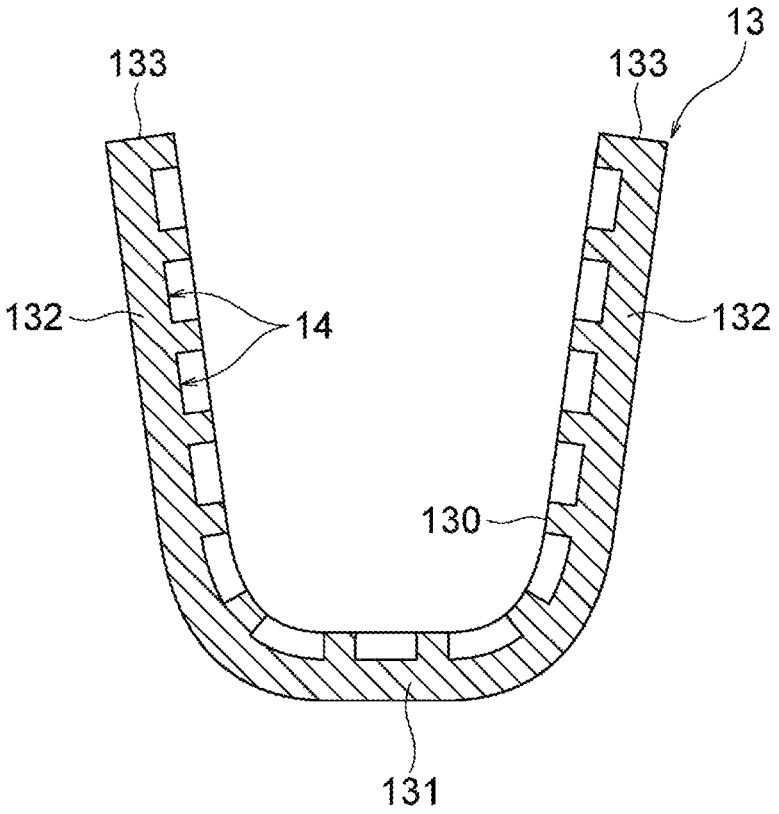
FIG. 3 is a cross-sectional view taken along line III-III of FIG. 2.
Figure 4:
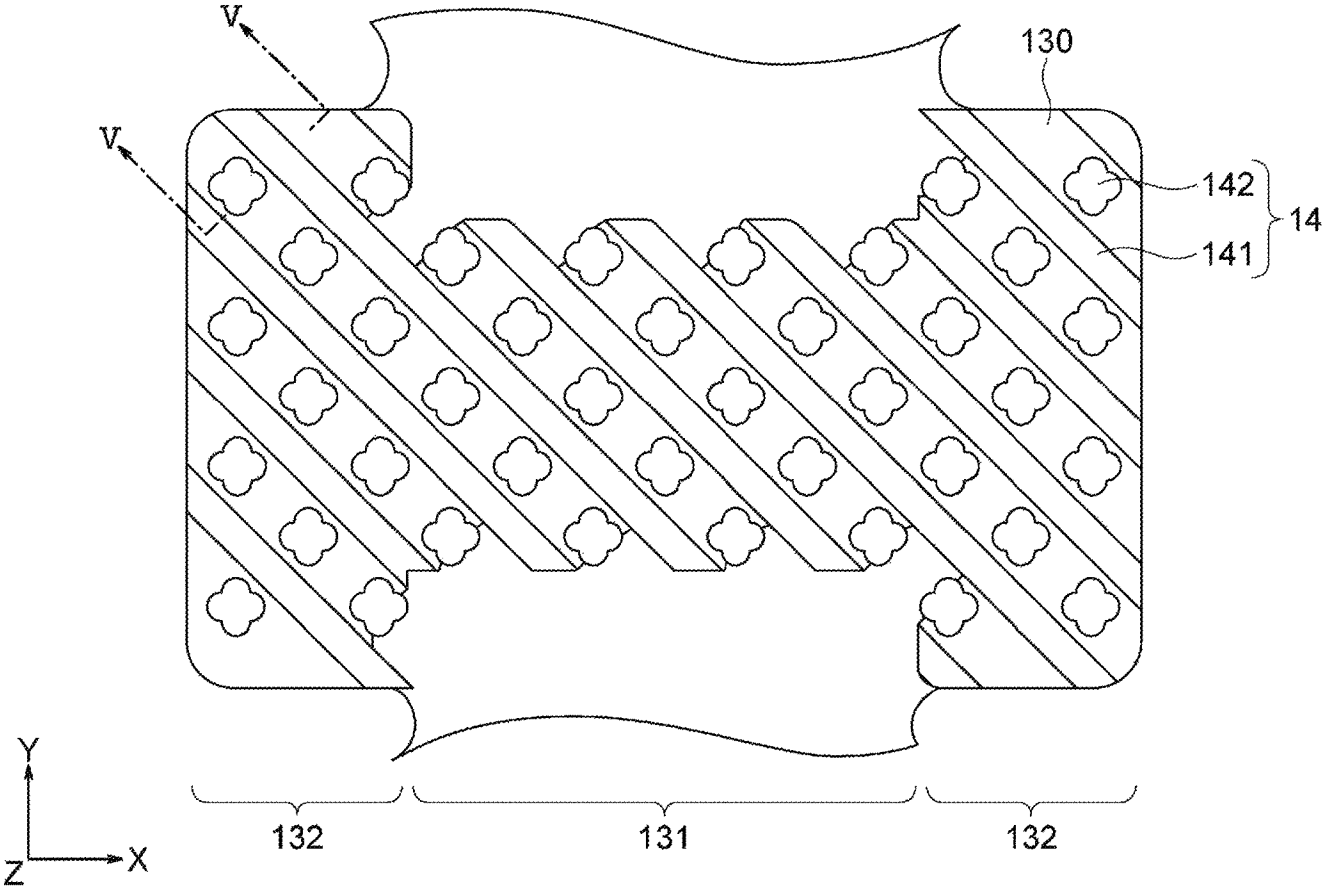
FIG. 4 is a development view illustrating a barrel of the crimp terminal in the first embodiment of the invention.
Figure 5:
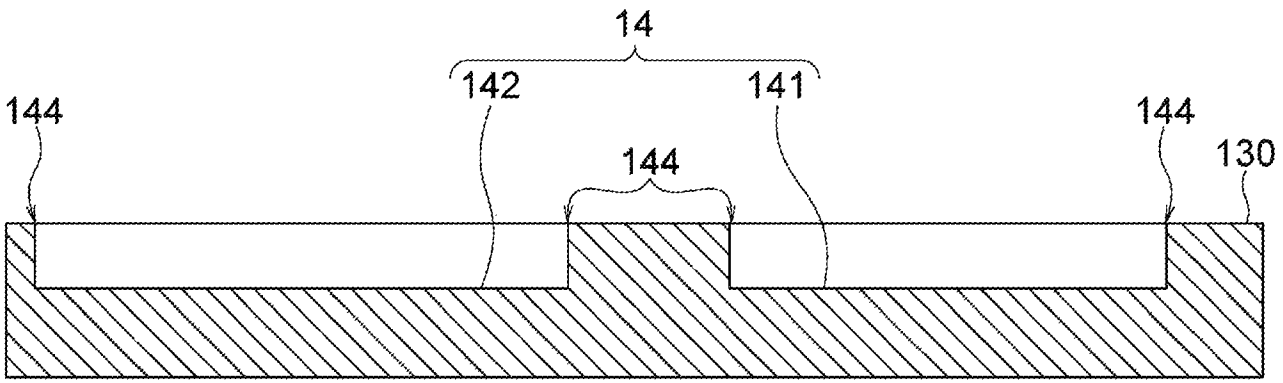
FIG. 5 is a cross-sectional view taken along line V-V of FIG. 4.
Figure 6:
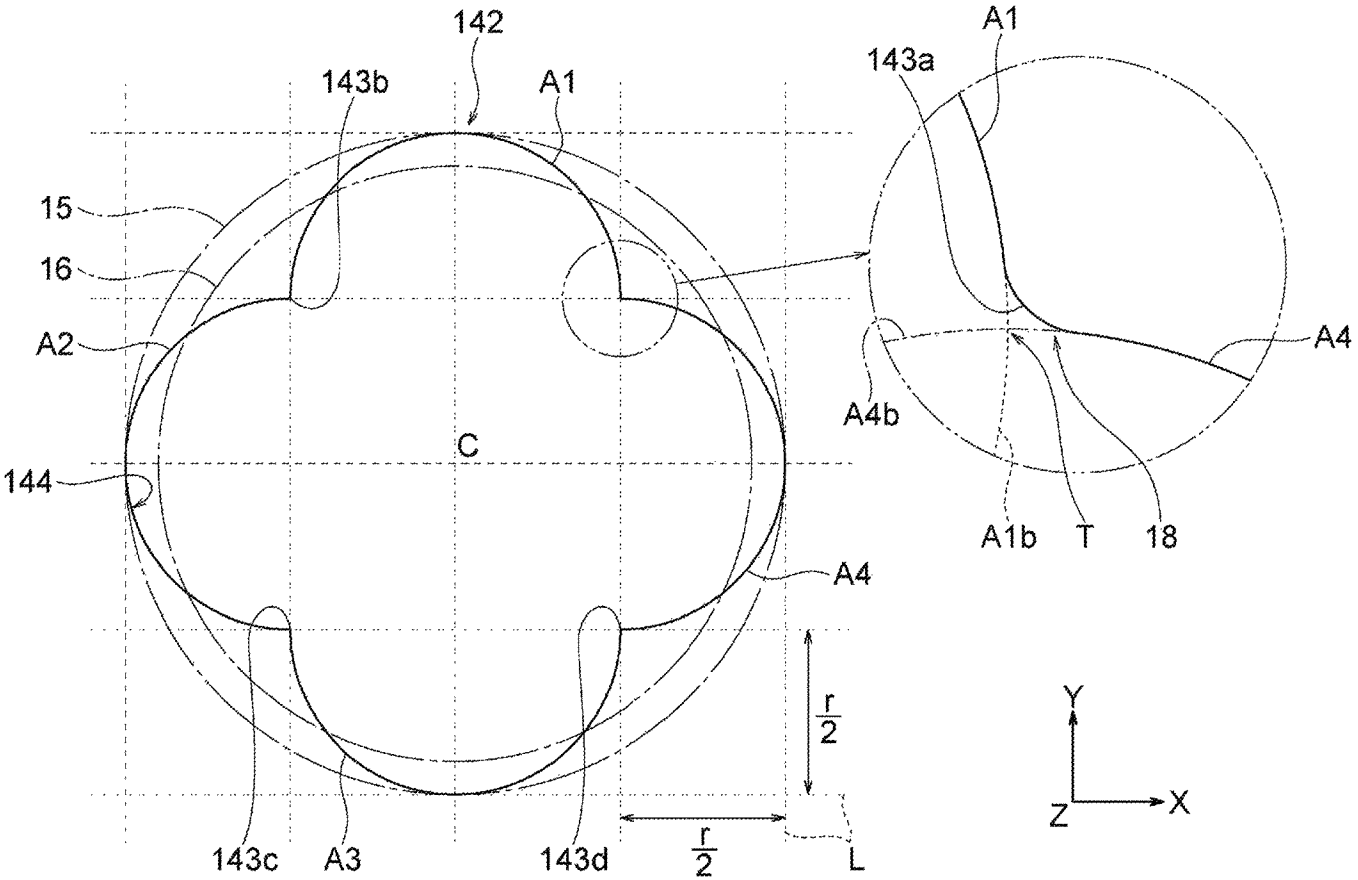
FIG. 6 is a plan view of an island-shaped portion of a serration formed on the barrel of the crimp terminal in the first embodiment of the invention.

FIG. 1 is a perspective view of a crimp terminal 1 in the first embodiment of the invention, FIG. 2 is a side view of the crimp terminal 1 and a wire 2 in the first embodiment of the invention, FIG. 3 is a cross-sectional view taken along line III-III of FIG. 2, FIG. 4 is a development view illustrating a second barrel 13 of the crimp terminal 1 in the first embodiment of the invention, FIG. 5 is a cross-sectional view taken along line V-V of FIG. 4, and FIG. 6 is a plan view of an island-shaped portion of a serration.

The crimp terminal 1 in the present embodiment is a terminal which is attached to an end portion of a wire 2 (see FIG. 2) and is used to conduct electricity between a connecting-counterpart terminal and a conductor portion 21 of the wire 2 by being fitted to the connecting-counterpart terminal (not illustrated). As illustrated in FIGS. 1 and 2, the crimp terminal 1 includes a connecting portion 11, a first barrel 12, and a second barrel 13. The crimp terminal 1 is manufactured by pressing and bending a plate made of a metal material (copper, a copper alloy, iron, or the like). Tinning or the like may be performed on the surface of the plate which is used to manufacture the crimp terminal 1.

As illustrated in FIG. 2, the wire 2 attached to the crimp terminal 1 includes: a conductor portion 21; and a cover portion 22 which covers the conductor portion 21. The conductor portion 21 is made of a conductive material, such as aluminum or an aluminum alloy, and is formed by twisting a plurality of (for example, three or seven) thin wires 211. The wire 2 may be a single wire which includes a conductor portion 21 formed by one thin wire. An insulating material, such as a synthetic resin, can be exemplified as the material of the cover portion 22.

The connecting portion 11 of the crimp terminal 1 is provided at one end portion (an end portion corresponding to −Y side in FIG. 1) of the crimp terminal 1, and has a rectangular cross-sectional profile. The connecting portion 11 has a function of a receptacle which is electrically connected to a connecting-counterpart terminal (plug) (not illustrated) having a shape corresponding to the shape of the connecting portion 11 by being fitted to the connecting-counterpart terminal.

As illustrated in FIG. 2, a locking piece 112 in which a locking hole 111 is formed is provided on the bottom surface of the crimp terminal 1. For example, the locking piece 112 is engaged with a locking recess or a locking protrusion formed in a connector housing (not illustrated) into which the crimp terminal 1 is inserted, so that the position of the crimp terminal 1 is specified and fixed.

The structure or the shape of the connecting portion 11 or a method of connecting the connecting portion 11 to the connecting-counterpart terminal is not particularly limited. For example, the connecting portion 11 of the crimp terminal 1 may be a plug, and the connecting-counterpart terminal may be a receptacle.

The first barrel 12 of the crimp terminal 1 is a portion which is in contact with and fixed to the cover portion 22 of the wire 2 when the wire 2 is attached to the crimp terminal 1, and is provided at the other end portion (an end portion corresponding to +Y side in FIG. 1) of the crimp terminal 1 as illustrated in FIG. 1. The first barrel 12 includes a bottom portion 121 and side portions 122. The side portions 122 stand up from both ends of the bottom portion 121. Accordingly, the first barrel 12 has a substantially U shape when viewed in the extending direction of the wire 2 to be attached (a Y-axis direction in FIG. 1). The side portions 122 are bent (caulked) toward the cover portion 22 of the wire 2 placed on the bottom portion 121, so that the side portions 122 crimp and fix the cover portion 22. For this purpose, the first barrel 12 has a sufficient length (height) H1 (see FIG. 2) to crimp and fix the cover portion 22 of the wire 2.

The second barrel 13 is a portion which fixes the conductor portion 21 of the wire 2 when the wire 2 is attached to the crimp terminal 1, and is formed between the connecting portion 11 and the first barrel 12 as illustrated in FIGS.

1 and 3. The second barrel 13 in the present embodiment corresponds to an example of a barrel in the invention.

As illustrated in FIG. 3, the second barrel 13 also includes a bottom portion 131 and side portions 132. The side portions 132 stand up from both ends of the bottom portion 131, so that the second barrel 13 has a substantially U shape when viewed in the extending direction of the wire 2 to be attached (the Y-axis direction in FIG. 1). The side portions 132 are bent (caulked) toward the conductor portion 21 of the wire 2 placed on the bottom portion 131, so that the side portions 132 crimp and fix the cover portion 22. For this purpose, the second barrel 13 has a sufficient length (height) H2 to crimp and fix the cover portion 22 of the wire 2 (see FIG. 2). The width D of the second barrel 13 in the crimp terminal 1 is substantially equal to the length of the conductor portion 21 of the wire 2 as illustrated in FIG. 2.

When the wire 2 is to be attached to the crimp terminal 1, first, the cover portion 22 of the wire 2 is placed on the bottom portion 121 of the first barrel 12, and the conductor portion 21 of the wire 2 is placed on the bottom portion 131 of the second barrel 13 (see an arrow of FIG. 2). Then, the side portions 122 are bent so that tip portions 123 of the two side portions 122 of the first barrel 12 press a substantially widthwise central portion of the cover portion 22 a −Z direction in FIG. 2.

Likewise, the side portions 132 are bent so that tip portions 133 of the two side portions 132 of the second barrel 13 press a substantially widthwise central portion of the conductor portion 21 toward the −Z direction in FIG. 2. Accordingly, the wire 2 is fixed to the crimp terminal 1, and the conductor portion 21 of the wire 2 is crimped to an inner surface (crimp surface) 130 of the second barrel 13.

As illustrated in FIGS. 1 and 3, a serration 14 is provided on the inner surface 130 of the second barrel 13 in the present embodiment. As illustrated in FIG. 4, the serration 14 is formed on the entire inner surface 130 of each side portion 132 of the second barrel 13 and are formed on a substantially middle portion of the inner surface 130 of the bottom portion 131. As long as a region where the serration 14 is formed in the inner surface 130 of the second barrel 13 includes a portion which comes into contact with the conductor portion 21 of the wire 2 when the wire 2 is attached to the crimp terminal 1, it is not particularly limited to the above. For example, the serration 14 may be formed on only the entire inner surface 130 of the bottom portion 131 of the second barrel 13.

As illustrated in FIGS. 4 and 5, the serration 14 in the present embodiment includes linear portions 141 and island-shaped portions 142.

As illustrated in FIG. 4, the linear portions 141 of the serration 14 are formed so as to extend along a direction inclined with respect to the Y direction in FIG. 4. A total of ten linear portions 141 are formed in parallel so as to be arranged at substantially regular intervals in the present embodiment, but the number of the linear portions 141 formed on the inner surface 130 of the second barrel 13 is not particularly limited. A direction in which the linear portions 141 are formed is also not particularly limited. For example, the linear portions 141 may be formed so as to extend along an X-axis direction in FIG. 4. The serrations 14 may be formed so that the linear portions 141 are omitted. However, in terms of the improvement of stability in the connection between the second barrel 13 and the conductor portion 21 of the wire 2, it is preferable that the linear portions 141 are formed.

As shown in FIG. 5, the linear portions 141 are formed on the inner surface 130 of the second barrel 13 as recesses. Likewise, the island-shaped portions 142 are also formed on the inner surface 130 of the second barrel 13 as recesses. For example, these recesses can be formed by performing pressing on a plate (metal material) which is used to manufacture the crimp terminal 1. The depth of the recess forming the linear portion 141 and the depth of the recess forming the island-shaped portion 142 are substantially equal to each other in the present embodiment. However, the depths of these recesses are not particularly limited thereto. The depths of these recesses may be different from each other.

As illustrated in FIG. 4, the island-shaped portions 142 are formed between the linear portions 141, and the island-shaped portions 142 are disposed so as to be arranged at substantially regular intervals in the extending direction of the linear portion 141. The arrangement of the island-shaped portions 142 is not particularly limited thereto.

For example, an interval between the island-shaped portions 142 formed on one side of one linear portion 141 may be different from an interval between the island-shaped portions 142 formed on the other side of the linear portion 141. The island-shaped portions 142 which are disposed so as to be arranged in one row are formed between adjacent linear portions 141 in the present embodiment. However, the island-shaped portions 142 which are disposed so as to be arranged in a plurality of lines may be formed between adjacent linear portions 141. A plurality of linear portions 141 may be formed between a pair of lines each of which includes the island-shaped portions 142 arranged in one row.

The shape of an outer edge of the island-shaped portion 142 (the shape of an edge portion 144 (see FIG. 5) of the inner surface 130 in the plan view) is formed so that four arcs A1 to A4 continue to each other as illustrated in FIG. 6. Each of the arcs A1 to A4 is formed in a convex shape which faces outside from a center C of the island-shaped portion 142.

Specifically, the first arc A1 is formed in a convex shape protruding toward a +Y direction in FIG. 6, and the left end of the first arc A1 is connected to the right end of the second arc A2. The second arc A2 is formed in a convex shape protruding toward a −X direction in FIG. 6, and the left end of the second arc A2 is connected to the right end of the third arc A3. The third arc A3 is formed in a convex shape protruding toward a −Y direction in FIG. 6, and the left end of the third arc A3 is connected to the right end of the fourth arc A4. The fourth arc A4 is formed in a convex shape protruding toward a +X direction in FIG. 6, and the left end of the fourth arc A4 is connected to the right end of the first arc A1.

In the present embodiment, each of the first to fourth arcs A1 to A4 is formed in the shape of a true semicircle having a radius r/2. For this reason, a circumscribed circle 15 which is circumscribed about the shape of the outer edge of the island-shaped portion 142 is a true circle. In FIG. 6, broken lines L drawn along an X axis and a Y axis are virtual grids (squares having a width r/2) which allow the shape of the outer edge of the island-shaped portion 142 to be easily grasped.

The "circumscribed circle" in the present embodiment is the smallest virtual circle which is in point contact with all the arcs A1 to A4 forming the island-shaped portion 142. For example, in a case in which the radii of the arcs forming the island-shaped portion 142 are different from each other, the circumscribed circle is an ellipse. In the present embodiment, since each of the arcs A1 to A4 forming the island-shaped portion 142 is formed in the shape of a true semicircle as described above, the circumscribed circle 15 is a true circle. The circumscribed circle 15 in the present embodiment corresponds to an example of "a smallest circle which is circumscribed about the shape of an outer edge" in the invention.

In the present embodiment, as illustrated in an enlarged view drawn to the right in FIG. 6, a round shape 18 which is convex toward a center C of the island-shaped portion 142 is formed at a connected portion 143*a* between the first arc A1 and the fourth arc A4 which form the shape of the outer edge of the island-shaped portion 142. Due to this round shape 18, the connected portion 143*a* is positioned so as to be slightly more distant to the outside from the center C than an intersection T between a virtual extended line A1*b* of the first arc A1 and a virtual extended line A4*b* of the fourth arc A4.

In the present embodiment, a round shape 18 is also formed at a connected portion 143*b* between the first arc A1 and the second arc A2 as in the case of the connected portion 143*a*. A round shape 18 is also formed at a connected portion 143*c* between the second arc A2 and the third arc A3 as in the case of the connected portion 143*a*. A round shape 18 is also formed at a connected portion 143*d* between the third arc A3 and the fourth arc A4 as in the case of the connected portion 143*a*. A ratio of the length of a portion of the edge portion 144 which is occupied by the round shapes 18 formed at the island-shaped portion 142 with respect to the entire length of the edge portion 144 in the shape of the outer edge of the island-shaped portion 142 is 5% or less. The connected portions 143*a* to 143*d* may be vertexes (intersections T) where the arcs A1 to A4 intersect each other. However, since the connected portions 143*a* to 143*d* are formed of the round shapes 18, it is possible to easily from the serration 14.

In the present embodiment, all the island-shaped portions 142 formed on the inner surface 130 of the second barrel 13 are disposed in the same direction as illustrated in FIG. 4. That is, among the four arcs A1 to A4 forming the shape of the outer edge of each island-shaped portion 142, the second arc A2 and the fourth arc A4 are disposed along the X-axis direction so as to face each other with the Y axis interposed therebetween. On the other hand, among the four arcs A1 to A4 forming the shape of the outer edge of each island-shaped portion 142, the first arc A1 and the third arc A3 are disposed along the Y-axis direction so as to face each other with the X axis of FIG. 6 interposed therebetween.

The disposition (direction) of the island-shaped portions 142 formed on the inner surface 130 of the second barrel 13 is not particularly limited to the above-mentioned disposition (direction). For example, the respective island-shaped portions 142 may be disposed (directed) so as to be rotated from the disposition (direction) illustrated in FIG. 4 by a predetermined angle (for example, 45°). The respective island-shaped portions 142 formed on the inner surface 130 of the second barrel 13 may be disposed (directed) in different ways.

Figure 7A:
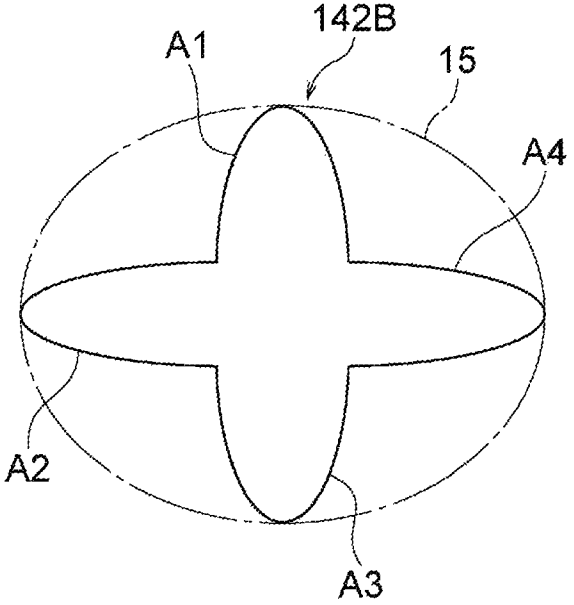
FIGS. 7(A) to 7(C) are plan views respectively illustrating first to third modifications of the serration in the first embodiment of the invention.
Figure 7B:
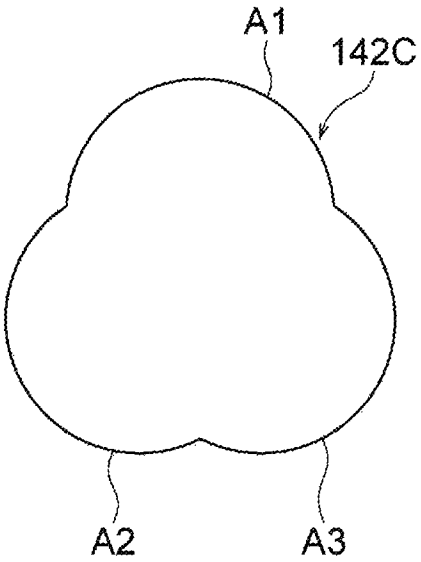
Figure 7C:
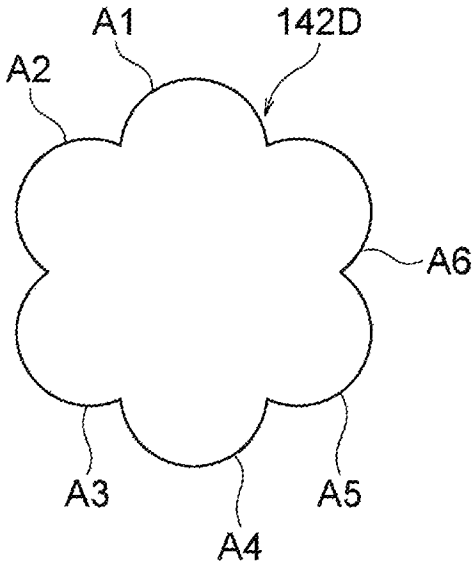

The shape of the island-shaped portion 142 is also not particularly limited to the above-mentioned shape. FIGS. 7(A) to 7(C) are plan views illustrating modifications of the island-shaped portion of the serration in the present embodiment.

For example, as in an island-shaped portion 142B illustrated in FIG. 7(A), each of four arcs A1 to A4 forming the island-shaped portion 142B may be an arc corresponding to a part of an ellipse. Although not particularly illustrated, an arc corresponding to a part of a true circle and an arc corresponding to a part of an ellipse may be used together.

A circumscribed circle 15 which is circumscribed about the island-shaped portion 142B has the shape of an ellipse in the case of an example illustrated in FIG. 7(A). In a case in which the circumscribed circle 15 has the shape of an ellipse in this way, in terms of the improvement of stability in connection between the second barrel 13 and the conductor portion 21 of the wire 2, it is preferable that the island-shaped portion 142B is disposed so that the direction of a major axis of the ellipse is along the X-axis direction in FIG. 4.

The number of arcs forming the island-shaped portion is also not particularly limited. For example, as in an island-shaped portion 142C illustrated in FIG. 7(B), the island-shaped portion 142C may include a total of three arcs A1 to A3. As in an island-shaped portion 142D illustrated in FIG. 7(C), the island-shaped portion 142D may include a total of six arcs A1 to A6.

The island-shaped portion has the shape of an axisymmetric outer edge in the above-mentioned examples. However, the island-shaped portion is not particularly limited thereto, and may have the shape of a non-axisymmetric outer edge.

Next, the function of the crimp terminal 1 in the present embodiment will be described.

In a case in which a wire which includes a conductor portion is made of aluminum or an aluminum alloy is connected to a crimp terminal, an oxide film having a high electric resistance value is generally formed on the surface of the conductor portion. For this reason, when crimping connection is performed, it is necessary to perform contact conduction between the crimp terminal and the conductor portion of the wire while the oxide film is broken.

In a case in which the crimp terminal includes the barrel on which the recessed serration are formed, the oxide film formed on the surface of the conductor portion is broken by edge portions of the serration when the barrel is crimped to the conductor portion of the wire. Accordingly, the crimp terminal and the conductor portion of the wire are electrically connected to each other. For this reason, in order to improve reliability in the connection between the crimp terminal and the conductor portion of the wire, it is preferable that the serration formed on the barrel is formed in a shape having a long outer edge.

In this regard, since the edge portion of the serration is short in a case in which the shape of the outer edge of the serration is a circular shape (a true-circular shape or an elliptical shape), it is necessary to increase the entire length of the edge portion by increasing an area which is occupied by the shape of the outer edge. However, if the area occupied by the shape of the outer edge is increased, energy required for forming the serration is increased. In this case, it is possible to suppress an increase in energy required for forming the serration by a structure in which the depth of the serration (the depth of the recessed shape) is reduced. However, since efficiency in which the edge portion of the serration breaks the oxide film of the conductor portion of the wire is reduced in this case, reliability in the connection between the crimp terminal and the conductor portion of the wire is reduced. For this reason, it is not possible to employ this structure.

On the other hand, in the present embodiment, the shape of the outer edge of the island-shaped portion 142 of the serration 14 formed on the inner surface 130 of the second barrel 13 is formed so that the plurality of arcs (the first to fourth arcs A1 to A4 in the present embodiment) continue to each other as illustrated in FIG. 6. For this reason, the outer edge of the serration 14 can be made long with respect to the area which is occupied by the shape of the outer edge of the island-shaped portion 142.

Specifically, in FIG. 6, each of the entire length of the edge portion 144 of the island-shaped portion 142 and the length of the circumference of the circumscribed circle 15 which is circumscribed about the shape of the outer edge of the island-shaped portion 142 is $2\pi r$. On the other hand, since the area occupied by the shape of the outer edge of the island-shaped portion 142 is $r^2+\pi r^2/2$ but the area of the circumscribed circle 15 is $\pi r^2$, the area occupied by the shape of the outer edge of the island-shaped portion 142 is smaller than the area of the circumscribed circle 15. For this reason, the length of the circumference of a circle 16 which has the same area as the area occupied by the shape of the outer edge of the island-shaped portion 142 is shorter than the length of the circumference of the circumscribed circle 15 (=the length of the circumference of the island-shaped portion 142). That is, the length of the circumference of the island-shaped portion 142 is longer than the length of the circumference of the circle 16 which has the same area as the area occupied by the shape of the outer edge of the island-shaped portion 142.

Accordingly, concerning the crimp terminal 1 in the present embodiment, it is possible to improve reliability in the connection between the crimp terminal 1 and the conductor portion 21 of the wire 2 while an increase in energy required for forming the serration 14 is suppressed. In a case in which the circumscribed circle 15 which is circumscribed about the shape of the outer edge of the island-shaped portion 142 is a true circle as illustrated in FIG. 6, it is possible to effectively increase the length of the circumference of the island-shaped portion 142 with respect to the length of the circumference of the circle 16 which has the same area as the area occupied by the shape of the outer edge of the island-shaped portion 142. Accordingly, it is possible to further improve reliability in the connection between the crimp terminal 1 and the conductor portion 21 of the wire 2.

Incidentally, when the crimp terminal is connected to the wire 2 in a case in which tinning is performed on the inner surface 130 of the second barrel 13, a newly formed surface made of tin fills a gap between the respective thin wires 211 while adhering to the thin wires 211 forming the conductor portion 21 of the wire 2. Accordingly, a gas-tight structure is obtained. For this reason, it is possible to further improve reliability in the connection between the crimp terminal 1 and the conductor portion 21 of the wire 2.

In the present embodiment, the shape of the outer edge of the island-shaped portion 142 is formed so that the four arcs A1 to A4 continue to each other. Accordingly, since the island-shaped portions 142 can be most densely disposed on the inner surface 130 of the second barrel 13, it is possible to further improve reliability in the connection between the crimp terminal 1 and the conductor portion 21 of the wire 2, and it is possible to suppress an increase in an electric resistance value between the crimp terminal 1 and the wire 2. This effect can be obtained not only in the case of the island-shaped portion 142C (see FIG. 7(B)) of which the shape of the outer edge is formed by three arcs A1 to A3 but also in the case of the island-shaped portion 142D (see FIG. 7(C)) of which the shape of the outer edge is formed by six arcs A1 to A6.

Second Embodiment

Figure 8:
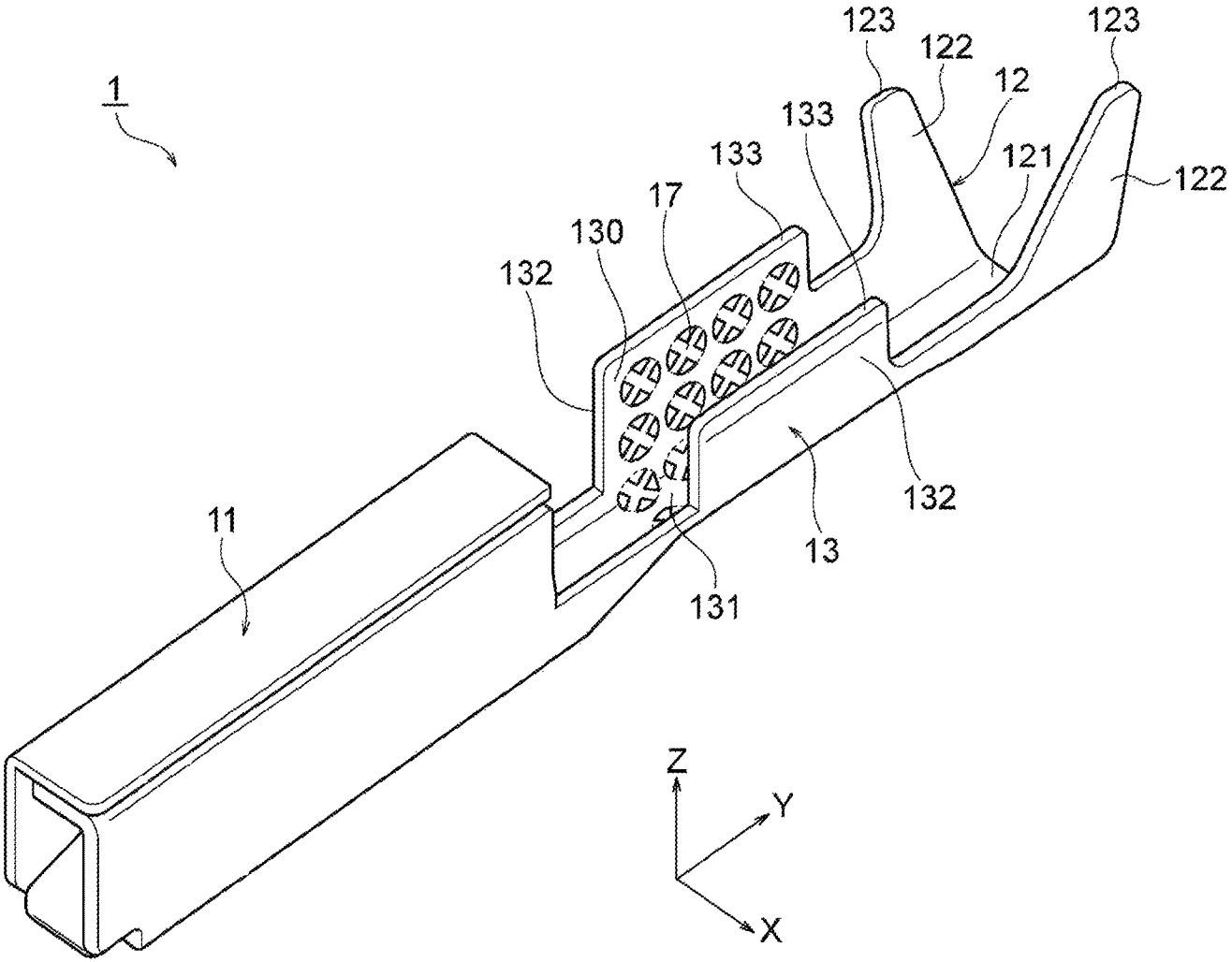
FIG. 8 is a perspective view of a crimp terminal in a second embodiment of the invention.
Figure 9:
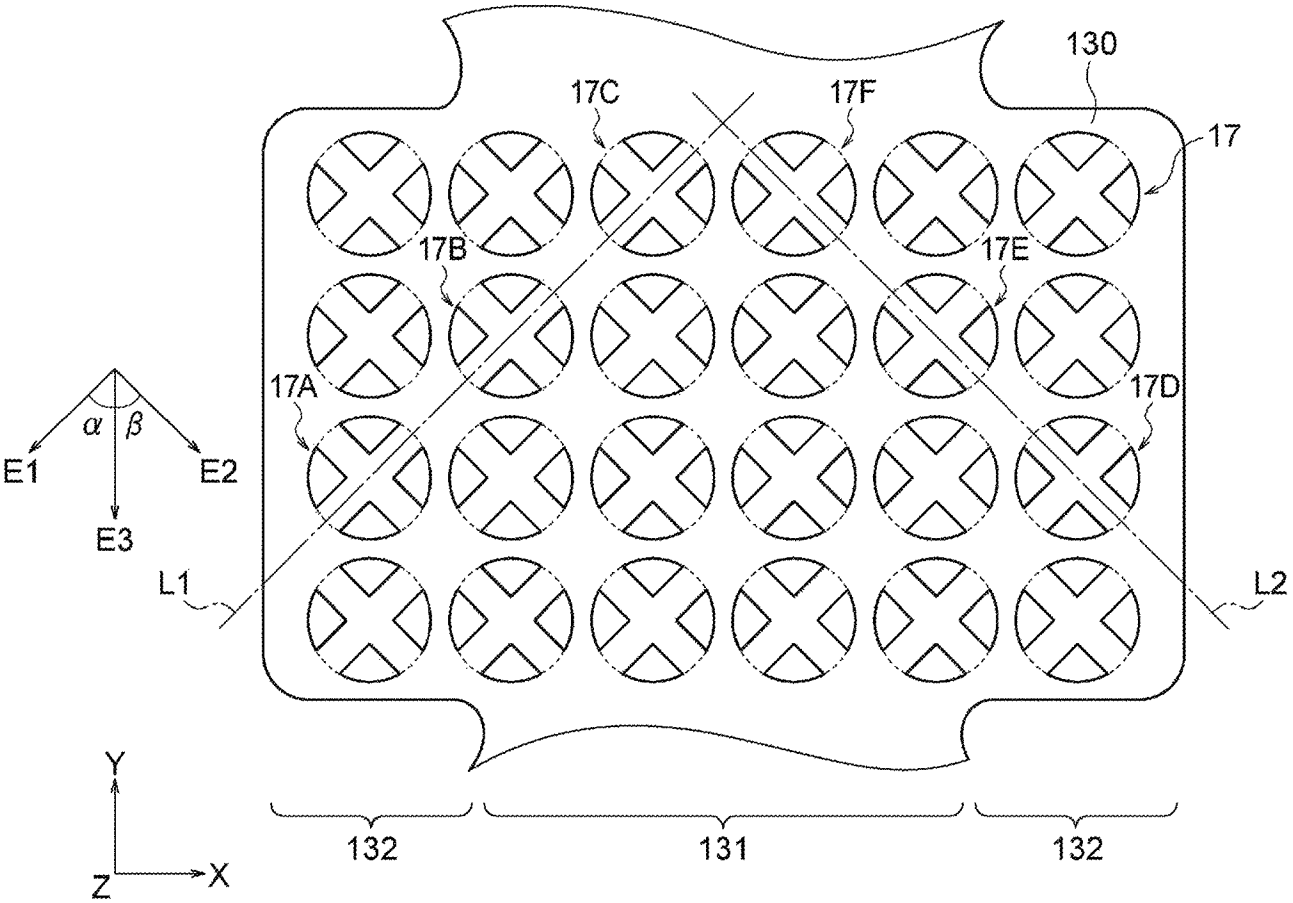
FIG. 9 is a development view illustrating a barrel of the crimp terminal in the second embodiment of the invention.
Figure 10:
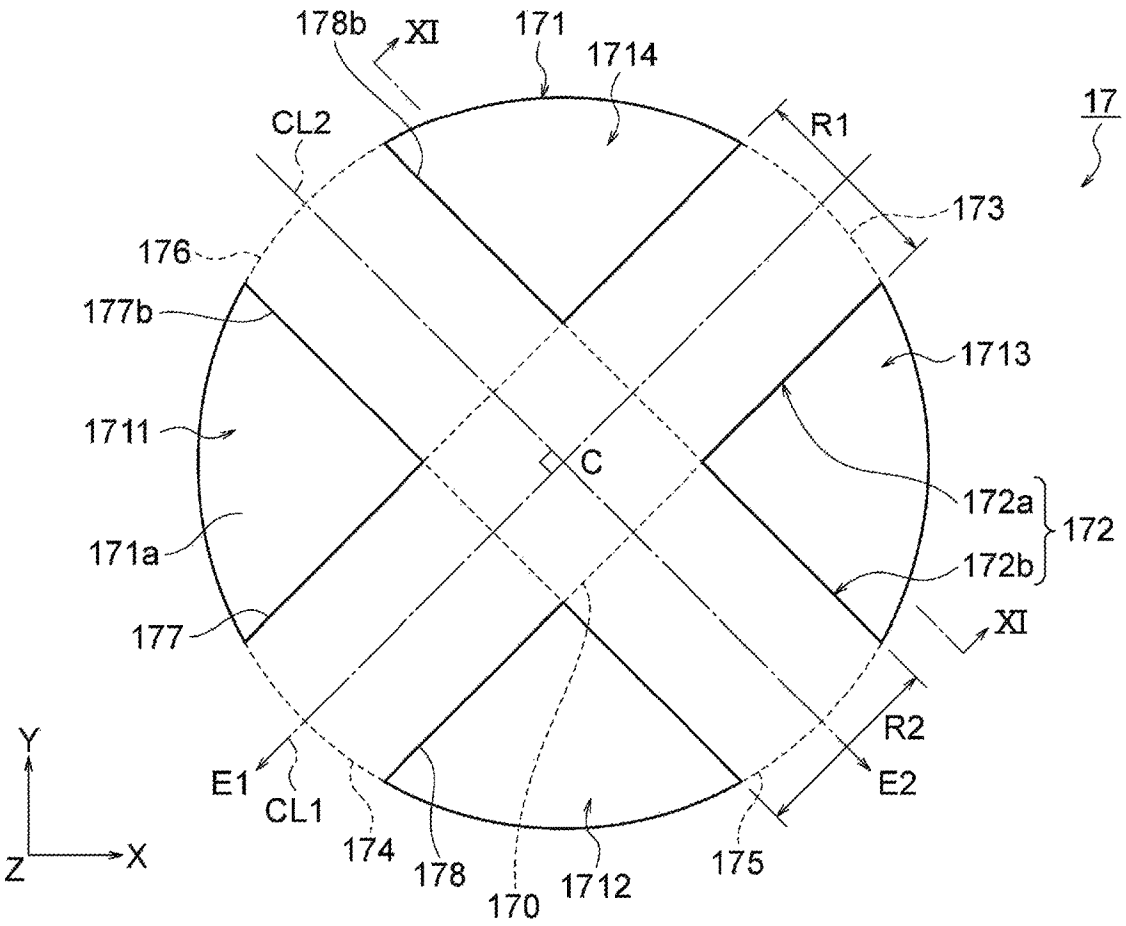
FIG. 10 is a plan view of a serration in the second embodiment of the invention.
Figure 11:
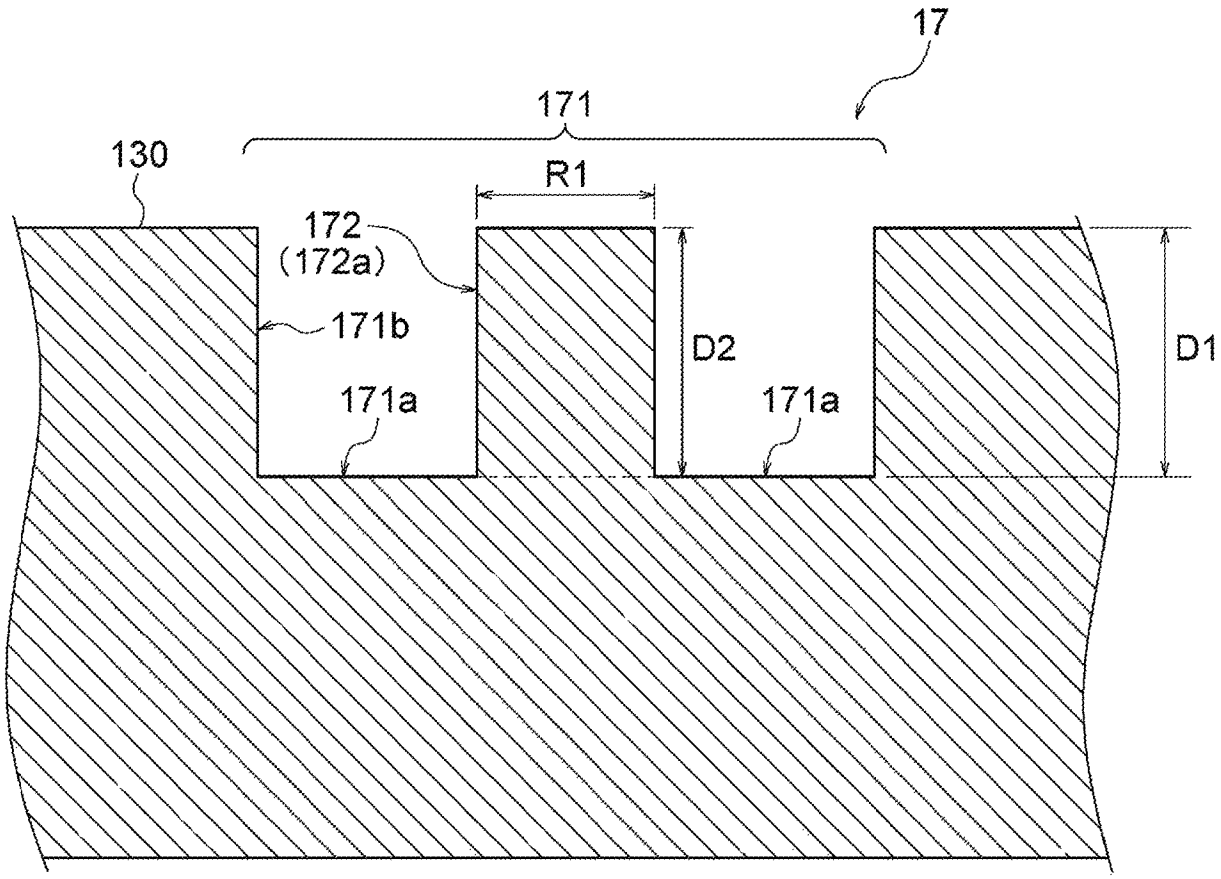
FIG. 11 is a diagram illustrating a cross-section taken along line XI-XI of FIG. 10.
Figure 12:
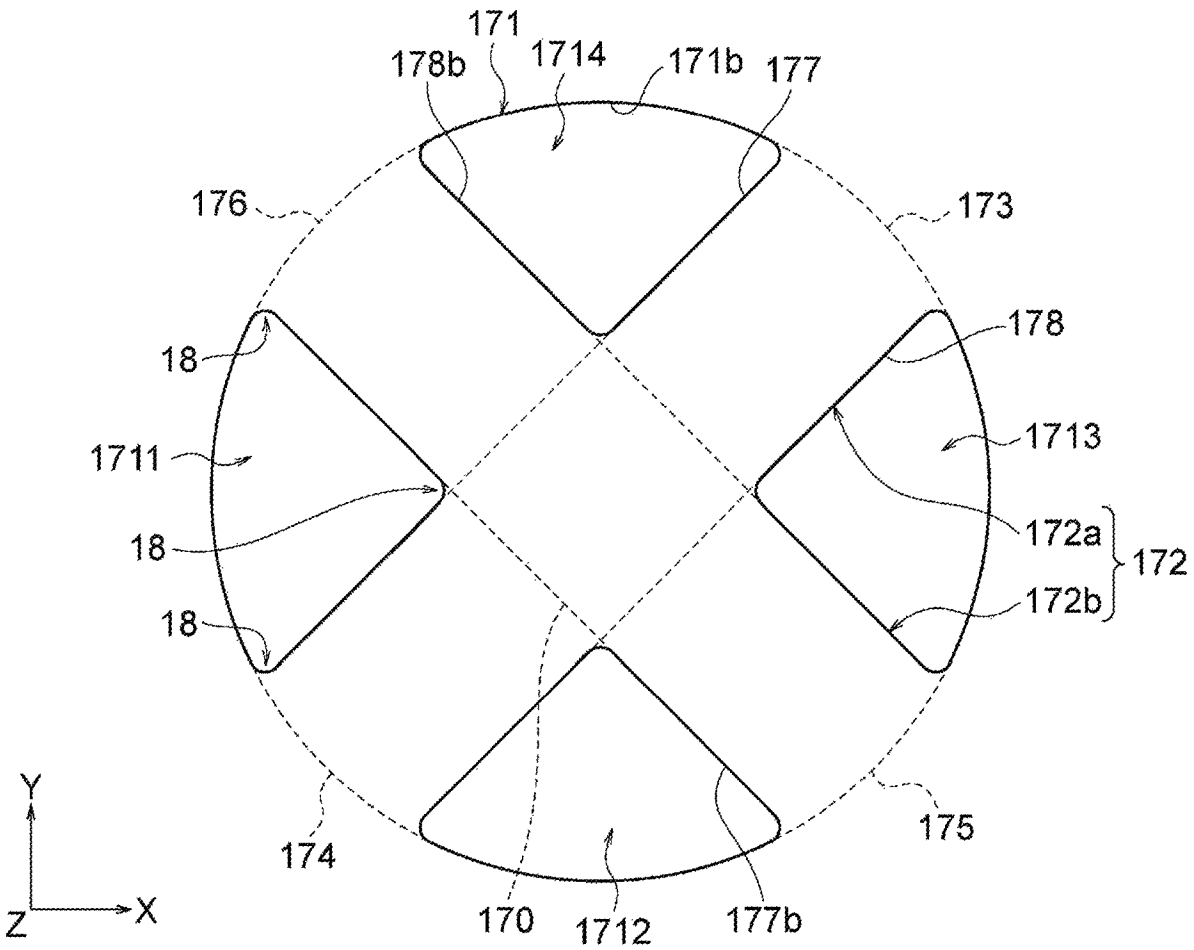
FIG. 12 is a plan view illustrating a modification of the serration in the second embodiment of the invention.

FIG. 8 is a perspective view of a crimp terminal in a second embodiment of the invention, FIG. 9 is a development view illustrating a second barrel of the crimp terminal in the second embodiment of the invention, FIG. 10 is a plan view of a serration in the second embodiment of the invention, FIG. 11 is a diagram illustrating a cross-section taken along line XI-XI of FIG. 10, and FIG. 12 is a plan view illustrating a modification of the serration in the second embodiment of the invention.

Since the crimp terminal in the second embodiment is the same as the crimp terminal in the above-mentioned first embodiment except that the structure of a serration 17 is different from that of the first embodiment, only portions different from the portions of the first embodiment will be described, the same portions as the portions of the first embodiment will be denoted by the same reference numerals as the reference numerals of the first embodiment, and the description thereof will be omitted.

As illustrated in FIGS. 8 and 9, serrations 17 are provided on the inner surface 130 of the second barrel 13 in the present embodiment. In the present embodiment, six serrations 17 are disposed at substantially regular intervals along the X-axis direction in FIG. 9, and four serrations 17 are disposed at substantially regular intervals along the Y-axis direction in FIG. 9. Accordingly, a total of twenty-four (6 columns×4 rows) serrations 17 are formed on the entire inner surface 130 of the second barrel. The number of the serrations 17 formed on the inner surface 130 is not particularly limited.

As long as a region where the serrations 17 are formed in the inner surface 130 of the second barrel 13 includes a portion which comes into contact with the conductor portion 21 of the wire 2 when the crimp terminal 1 is attached to the wire 2, it is not particularly limited to the above. For example, the serrations 17 may be formed on only the inner surface 130 of the bottom portion 131 of the second barrel 13.

As illustrated in FIG. 10 or 11, each of the serrations 17 in the present embodiment includes: a recess 171 which has a true-circular contour in a plan view; and a protrusion 172 which is formed in the recess 171.

As illustrated in FIG. 11, the recess 171 has the shape of a recess which includes a bottom surface 171*a* and a side surface 171*b* and which has a depth D1. In the present embodiment, the side surface 171*b* is formed substantially perpendicular to the inner surface 130 of the second barrel 13, and the bottom surface 171*a* is formed substantially parallel to the inner surface 130. The contour of the recess 171 is not particularly limited to a true-circular shape and may be an elliptical shape.

The protrusion 172 in the present embodiment has a planar shape including a first strip shape 172*a* and a second strip shape 172*b* each of which extends linearly. A portion corresponding to the first strip shape 172*a* is formed on the bottom surface 171*a* of the recess 171 as illustrated in FIG. 11 and has the shape of a protrusion which has a constant width (a width between a side surface 177 and a side surface 178) R1 in a plan view and which has a substantially rectangular cross-section. A height D2 of the shape of the protrusion is substantially equal to the depth D1 of the recess 171 (D2=D1). The height D2 of the shape of the protrusion may be slightly smaller than the depth D1 of the recess 171. However, in terms of the improvement of reliability in connection between the crimp terminal 1 and the conductor portion 21 of the wire 2, it is preferable that the height D2 of the shape of the protrusion is substantially equal to the depth D1 of the recess 171.

A portion corresponding to the second strip shape 172*b* is also formed on the bottom surface 171*a* of the recess 171. The portion corresponding to the second strip shape 172*b* has the shape of a protrusion which has a constant width (a width between a side surface 177*b* and a side surface 178*b*)

R2 in a plan view and which has a substantially rectangular cross-section. A height of the shape of the protrusion is substantially equal to the depth D1 of the recess 171. A width R2 of the second strip shape 172*b* is substantially equal to a width R1 of the first strip shape 172*a* (R2=R1) in the present embodiment, but these widths R1 and R2 may be different from each other. The first and second strip shapes 172*a* and 172*b* may not have a constant width.

In the present embodiment, a center line CL1 of the first strip shape 172*a* intersects a center line CL2 of the second strip shape 172*b* substantially at a right angle in a plan view. That is, an angle between an extending direction E1 of the first strip shape 172*a* and an extending direction E2 of the second strip shape 172*b* is 90°. An intersection between the two center lines CL1 and CL2 corresponds to a center C of the shape of the contour (true circle) of the serration 17. Accordingly, an overlapping portion 170 where the first strip shape 172*a* and the second strip shape 172*b* overlap each other is formed substantially at the center of the serration 17 in a plan view. The two center lines CL1 and CL2 may not intersect each other at a right angle, and the intersection between the two center lines CL1 and CL2 may not correspond to the center C.

Both end portions 173 and 174 of the first strip shape 172*a* in the extending direction E1 of the first strip shape 172*a* continue to the side surface 171*b* of the recess 171. Accordingly, both the end portions 173 and 174 are connected to the contour of the recess 171 in a plan view. Both end portions 175 and 176 of the second strip shape 172*b* in the extending direction E2 of the second strip shape 172*b* also continue to the side surface 171*b* of the recess 171, and are connected to the contour of the recess 171 in a plan view.

For this reason, the recess 171 in the present embodiment is partitioned into four recessed portions (a first recessed portion 1711, a second recessed portion 1712, a third recessed portion 1713, and a fourth recessed portion 1714) by the protrusion 172.

In plan view, the first recessed portion 1711 has a fan shape which is defined by the side surface 171*b* of the recess 171, the side surface 177 of the first strip shape 172*a*, and the side surface 177*b* of the second strip shape 172*b*. In plan view, the second recessed portion 1712 has a fan shape which is defined by the side surface 171*b* of the recess 171, the side surface 178 of the first strip shape 172*a*, and the side surface 177*b* of the second strip shape 172*b*.

In plan view, the third recessed portion 1713 has a fan shape which is defined by the side surface 171*b* of the recess 171, the side surface 178 of the first strip shape 172*a*, and the side surface 178*b* of the second strip shape 172*b*. In plan view, the fourth recessed portion 1714 has a fan shape which is defined by the side surface 171*b* of the recess 171, the side surface 177 of the first strip shape 172*a*, and the side surface 178*b* of the second strip shape 172*b*.

In the present embodiment, these first to fourth recessed portions 1711 to 1714 have the fan shapes which are substantially equal to each other in a plan view, and all the central angles of these fan shapes are 90°. The total length of linear portions of the fan shapes of the first to fourth recessed portions 1711 to 1714 (linear portions formed by the side surfaces 177 and 178 of the first strip shape 172*a* or the side surfaces 177*b* and 178*b* of the second strip shape 172*b*) is longer than the total length of the end portions 173 to 176 of the first and second strip shapes 172*a* and 172*b* in a plan view.

The shape of the serration 17 is not particularly limited to the above-mentioned shape. For example, round shapes 18 may be formed on the peripheries of the first to fourth recessed portions 1711 to 1714 as illustrated in FIG. 12. In an example of FIG. 12, concerning the first recessed portion 1711, the round shape 18 is formed between the side surface 171*b* of the recess 171 and the side surface 177 of the first strip shape 172*a*, the round shape 18 is formed between the side surface 171*b* of the recess 171 and the side surface 177*b* of the second strip shape 172*b*, and the round shape 18 is formed between the side surface 177 of the first strip shape 172*a* and the side surface 177*b* of the second strip shape 172*b*.

Likewise, concerning the second to fourth recessed portions 1712 to 1714, the round shape 18 is formed between the side surface 171*b* of the recess 171 and the side surface 177 or 178 of the first strip shape 172*a*, the round shape 18 is formed between the side surface 171*b* of the recess 171 and the side surface 177*b* or 178*b* of the second strip shape 172*b*, and the round shape 18 is formed between the side surface 177 or 178 of the first strip shape 172*a* and the side surface 177*b* or 178*b* of the second strip shape 172*b*. It is preferable that a ratio of the length of all portions in which the round shapes 18 are formed with respect to the entire length of the outer edges of the first to fourth recessed portions 1711 to 1714 in a plan view is 5% or less. In a case in which such round shapes 18 are formed, it is possible to improve the workability of the serrations 17.

The following Equation (3) is satisfied in the present embodiment.

$$\alpha=45° \tag{3}$$

Here, in the Equation (3), a denotes an angle between an extending direction E3 of the conductor portion 21 of the wire 2 which is to be connected to the crimp terminal 1 and the extending direction E1 of the first strip shape 172*a*, and β denotes an angle between the extending direction E3 of the conductor portion 21 and the extending direction E2 of the second strip shape 172*b* (see FIG. 9).

In the present embodiment, as illustrated in FIG. 9, the posture directions of all the serrations 17 formed on the main surface 130 of the second barrel 13 are the same, and the serrations 17 are disposed along the extending directions E1 and E2. The posture directions and disposition of the serrations 17 formed on the main surface 130 of the second barrel 13 are not particularly limited to the above-mentioned posture directions and disposition. The posture directions of some serrations 17 formed on the main surface 130 of the second barrel 13 may be different from the posture directions of the other serrations 17 formed on the principal surface 130.

As described above, the serration 17 in the present embodiment includes the recess 171, and the protrusion 172 is formed in the recess 171. For this reason, in comparison with a serration including a recessed portion having the same contour as the contour of the serration 17 (a true circle in the present embodiment), the edge portion formed within the contour can be made long. Accordingly, in the crimp terminal 1 of the present embodiment, it is possible to improve reliability in the connection between the crimp terminal 1 and the conductor portion 21 of the wire 2 while an increase in energy required for forming the serration 17 is suppressed. In the present embodiment, the first and second strip shapes 172*a* and 172*b* pass through the center C of the contour of the recess 171B, and the edge portion formed within the contour can be effectively made long. Accordingly, it is possible to further improve the above-mentioned effect.

The protrusion 172 formed in the recess 171 of the serration 17 in the present embodiment is connected to the side surface 171*b* of the recess 171. That is, the end portions 173 and 174 of the first strip shape 172*a* and the end portions 175 and 176 of the second strip shape 172*b* are connected to the side surface 171*b* of the recess 171. For this reason, it is possible to suppress the occurrence of the bending or folding of the protrusion 172 which is caused by crimping when the crimp terminal 1 is connected to the conductor portion 21 of the wire 2, and it is possible to more reliably connect the crimp terminal 1 to the conductor portion 21 of the wire 2. Since the first and second strip shapes 172*a* and 172*b* are orthogonal to each other at the center C in the present embodiment, this effect can be further improved.

In the present embodiment, the serrations 17 formed on the main surface 130 of the second barrel 13 are linearly disposed along the extending direction E1 of the first strip shape 172*a*. For example, first strip shapes 172*a* of serrations 17A, 17B, and 17C illustrated in FIG. 9 are disposed on the same line L1. In this case, it is possible to easily form dies which are used for forming the serrations 17 by pressing or the like.

Likewise, the serrations 17 of the crimp terminal 1 in the present embodiment are linearly disposed along the extending direction E2 of the second strip shape 172*b*. For example, second strip shapes 17*b* of serrations 17D, 17E, and 17F illustrated in FIG. 9 are disposed on the same line L2. For this reason, it is possible to more easily form dies which are used for forming the serrations 17.

The Equation (3) is satisfied in the present embodiment. For this reason, when the crimp terminal 1 is crimped, the oxide film formed on the surface of the conductor portion 21 of the wire 2 is easily broken by the serrations 17. Accordingly, it is possible to further improve reliability in the connection between the crimp terminal 1 and the conductor portion 21 of the wire 2.

Third Embodiment

Figure 13:
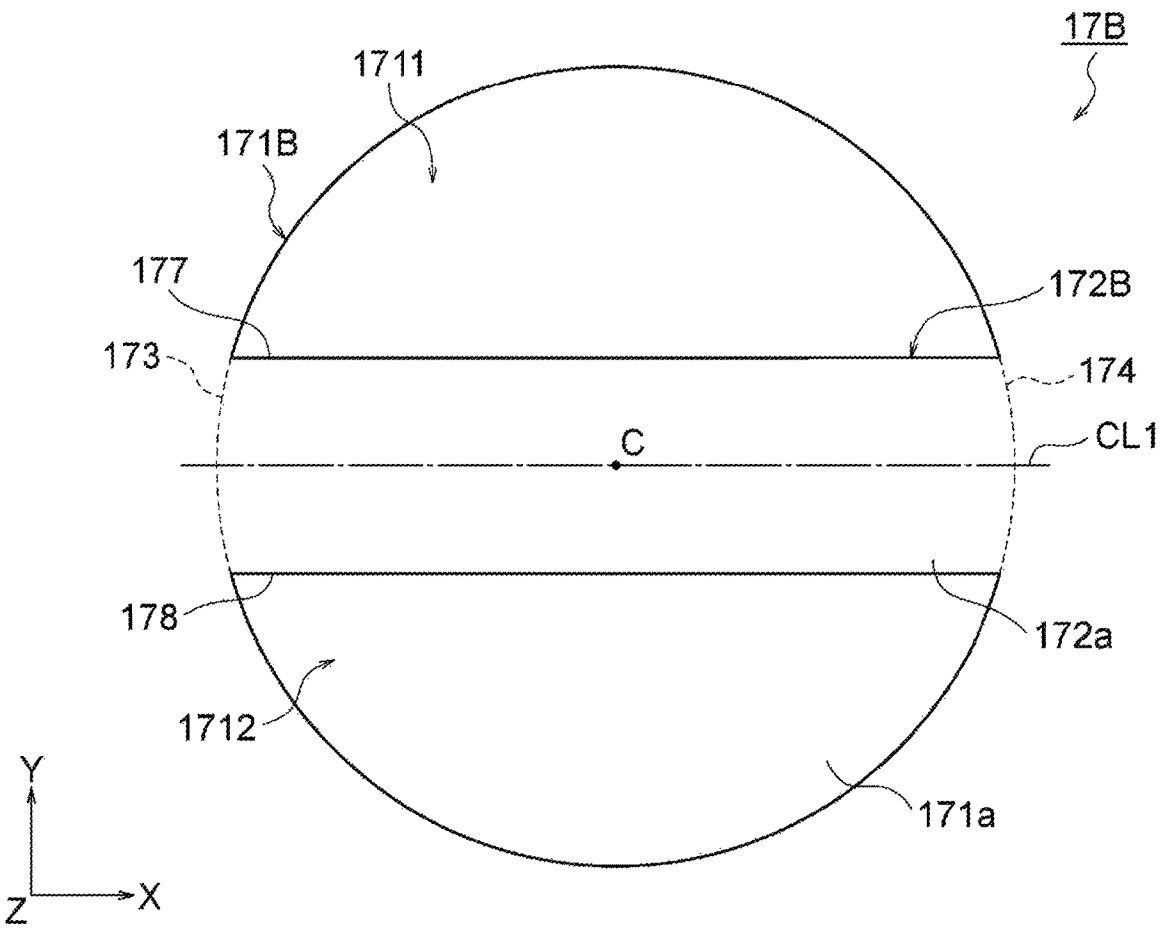
FIG. 13 is a plan view of a serration in a third embodiment of the invention.
Figure 14:
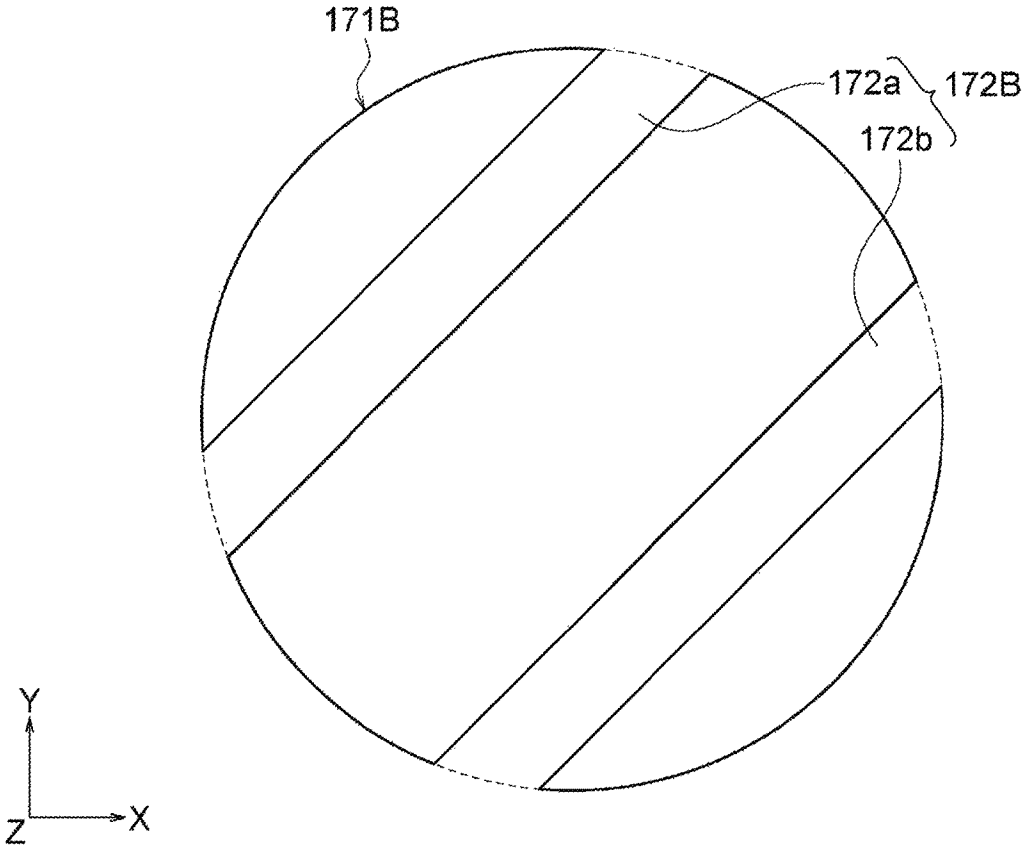
FIG. 14 is a plan view illustrating a modification of the serration in the third embodiment of the invention.

FIG. 13 is a plan view of a serration of a crimp terminal in a third embodiment of the invention, and FIG. 14 is a plan view illustrating a modification of the serration of the crimp terminal in the third embodiment of the invention.

Since the crimp terminal in the third embodiment is the same as the crimp terminal in the above-mentioned second embodiment except that the structure of a serration is different from that of the second embodiment, only portions different from the portions of the second embodiment will be described, the same portions as the portions of the second embodiment will be denoted by the same reference numerals as the reference numerals of the second embodiment, and the description thereof will be omitted.

As illustrated in FIG. 13, a serration 17B in the present embodiment includes; a recess 171B which has a true-circular contour; and a protrusion 172B which is formed in the recess 171B.

The recess 171B has the same shape as the shape of the recess 171 described in the second embodiment. The protrusion 172B has a planar shape including only a linear first strip shape 172*a* of which a center line CL1 passes through a center C of the contour of the recess 171B. The protrusion 172B has the same cross-sectional shape as the cross-sectional shape of a portion which corresponds to the first strip shape 172*a* of the protrusion 172 described in the second embodiment. The protrusion 172B is provided on a bottom surface 171*a* of the recess 171B.

Both end portions 173 and 174 of the first strip shape 172*a* in an extending direction (an X-axis direction in FIG. 13) continue to a side surface 171*b* of the recess 171B. Accordingly, both the end portions 173 and 174 are connected to the contour of the recess 171B in a plan view. For this reason, in the present embodiment, the recess 171B is partitioned into two recessed portions (a first recessed portion 1711 and a second recessed portion 1712) by the protrusion 172B. The total length of linear portions of the first and second recessed portions 1711 and 1712 in a plan view (linear portions formed by side surfaces 177 and 178 of the first strip shape 172*a*) is longer than the total length of the end portions 173 and 174 of the first strip shape 172*a* in a plan view.

The structure of the serration 17B is not particularly limited to the above-mentioned structure. For example, as illustrated in FIG. 14, the protrusion 172B may include a first strip shape 172*a* and a second strip shape 172*b* in a plan view, and these strip shapes 172*a* and 172*b* may be disposed substantially parallel to each other. In this case, the widths of the first and second strip shapes 172*a* and 172*b* may be equal to each other or may be different from each other. The first and second strip shapes 172*a* and 172*b* may not be parallel to each other.

As in the second embodiment, in comparison with a serration including a recessed portion having the same contour as the contour of the serration 17B, the edge portion formed within the contour can be made long in the present embodiment. Accordingly, it is possible to improve reliability in the connection between the crimp terminal 1 and the conductor portion 21 of the wire 2 while an increase in energy required for forming the serration 17B is suppressed. In the present embodiment, the first strip shape 172*a* passes through the center C of the contour of the recess 171B, and the edge portion formed within the contour can be effectively made long. Accordingly, it is possible to further improve the above-mentioned effect.

As in the second embodiment, the protrusion 172B is connected to the side surface 171*b* of the recess 171B in the present embodiment. For this reason, it is possible to suppress the occurrence of the bending or folding of the protrusion 172B which is caused by crimping when the crimp terminal 1 is connected to the conductor portion 21 of the wire 2, and it is possible to more reliably connect the crimp terminal 1 to the conductor portion 21 of the wire 2.

As in the second embodiment, since the serrations 17B are disposed along the extending direction of the first strip shape 172*a* on the main surface 130 of the second barrel 13 in the present embodiment, it is possible to improve the workability of the serrations 17B.

Fourth Embodiment

Figure 15:
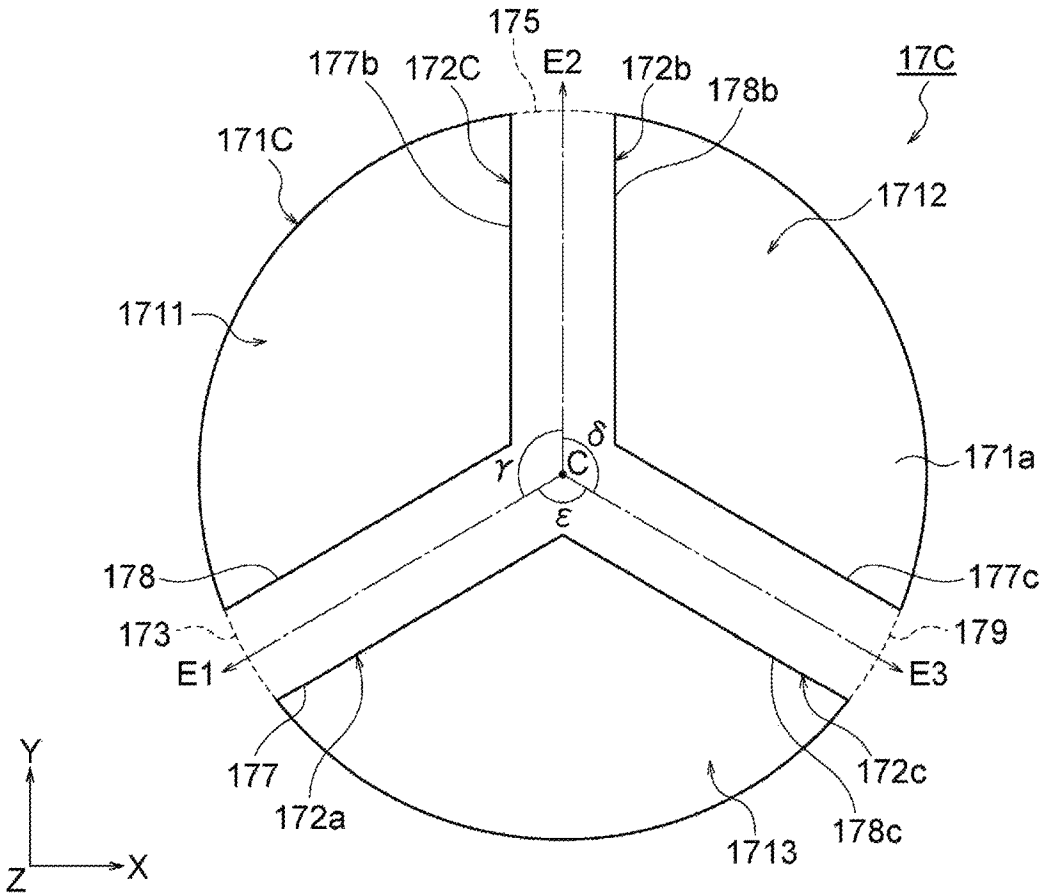
FIG. 15 is a plan view of a serration in a fourth embodiment of the invention.

FIG. 15 is a plan view of a serration of a crimp terminal in a fourth embodiment of the invention.

Since the crimp terminal in the fourth embodiment is the same as the crimp terminal in the above-mentioned second embodiment except that the structure of a serration is different from that of the second embodiment, only portions different from the portions of the second embodiment will be described, the same portions as the portions of the second embodiment will be denoted by the same reference numerals as the reference numerals of the second embodiment, and the description thereof will be omitted.

As illustrated in FIG. 15, a serration 17C in the present embodiment includes: a recess 171C which has a true-circular contour; and a protrusion 172C which is formed in the recess 171C.

The recess 171C has the same shape as the shape of the recess 171 described in the second embodiment. The protrusion 172C has a planar shape including a first strip shape 172*a*, a second strip shape 172*b*, and a third strip shape 172*c* each of which linearly extends to a center C from the contour of the recess 171C.

Each of the first to third strip shapes 172*a* to 172*c* has the same cross-sectional shape as the cross-sectional shape of a portion which corresponds to the first strip shape 172*a* of the protrusion 172 described in the second embodiment. The first to third strip shapes 172*a* to 172*c* are provided on a bottom surface 171*a* of the recess 171C. As illustrated in FIG. 15, the first to third strip shapes 172*a* to 172*c* are connected to each other at a center C of the contour of the recess 171C.

The following Equation (4) is satisfied in the present embodiment.

$$\gamma=\delta=\varepsilon=120^\circ \quad (4)$$

Here, in the Equation (4), γ denotes an angle between an extending direction E1 of the first strip shape 172*a* and an extending direction E2 of the second strip shape 172*b* (an angle on the side where the third strip shape 172*c* is not provided), δ denotes an angle between the extending direction E2 of the second strip shape 172*b* and an extending direction E3 of the third strip shape 172*c* (an angle on the side where the first strip shape 172*a* is not provided), and ε denotes an angle between the extending direction E3 of the third strip shape 172*c* and the extending direction E1 of the first strip shape 172*a* (an angle on the side where the second strip shape 172*b* is not provided).

For this reason, the recess 171C is partitioned into first to third recessed portions 1711 to 1713 by the protrusion 172C, and the first to third recessed portions 1711 to 1713 are formed in the fan shapes which are substantially equal to each other in a plan view. The total length of linear portions of the fan shapes of the first to third recessed portions 1711 to 1713 (linear portions formed by side surfaces 177 and 178 of the first strip shape 172*a*, side surfaces 177*b* and 178*b* of the second strip shape 172*b*, or side surfaces 177*c* and 178*c* the third strip shape 172*c*) is longer than the total length of end portion 173, 175, and 179 of the first to third strip shapes 172*a* to 172*c* in a plan view.

As in the second embodiment, in comparison with a serration including a recessed portion having the same contour as the contour of the serration 17C, the edge portion formed within the contour can be made long in the present embodiment. Accordingly, it is possible to improve reliability in the connection between the crimp terminal 1 and the conductor portion 21 of the wire 2 while an increase in energy required for forming the serration 17C is suppressed.

As in the second embodiment, the protrusion 172C is connected to a side surface 171*b* of the recess 171C in the present embodiment. For this reason, it is possible to suppress the occurrence of the bending or folding of the protrusion 172C which is caused by crimping when the crimp terminal 1 is connected to the conductor portion 21 of the wire 2, and it is possible to more reliably connect the crimp terminal 1 to the conductor portion 21 of the wire 2. Since the first to third strip shapes 172*a* to 172*c* are connected to each other at the center C of the contour of the recess 171C and the Equation (4) is satisfied in the present embodiment, it is possible to further improve this effect.

Fifth Embodiment

Figure 16A:
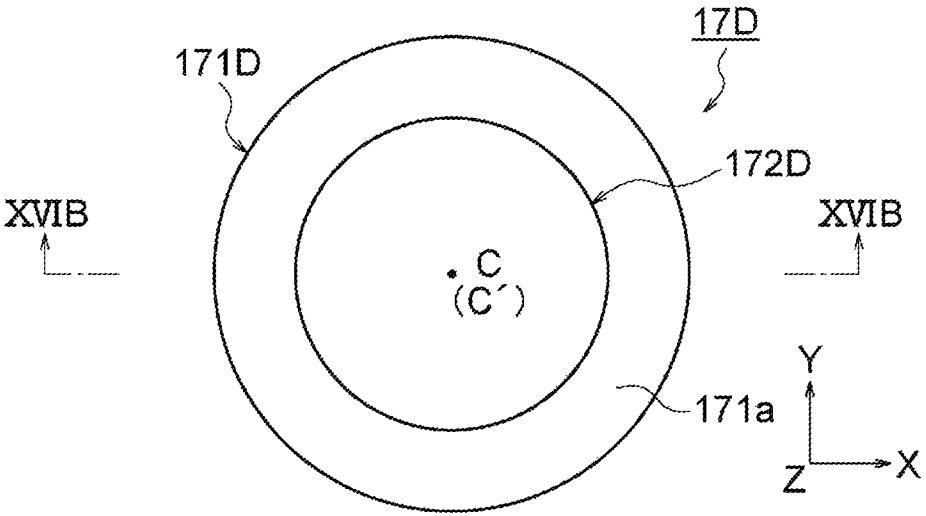
FIGS. 16(A) and 16(B) are diagrams illustrating a serration in a fifth embodiment of the invention.
Figure 16B:
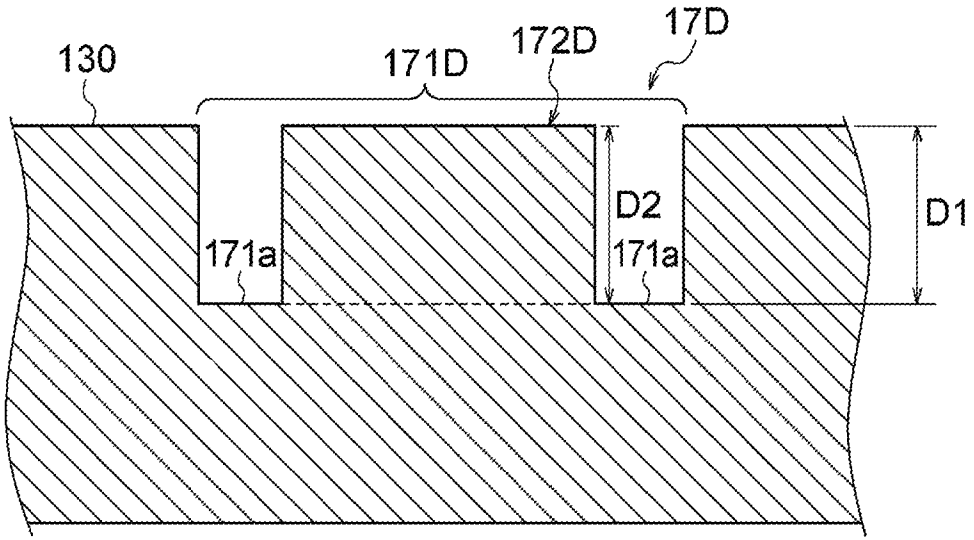

FIG. 16(A) is a plan view of a serration of a crimp terminal in a fifth embodiment of the invention, and FIG. 16(B) is a diagram illustrating a cross-section taken along line XVIB-XVIB of FIG. 16(A).

Since the crimp terminal in the fifth embodiment is the same as the crimp terminal in the above-mentioned second embodiment except that the structure of a serration is different from that of the second embodiment, only portions different from the portions of the second embodiment will be described, the same portions as the portions of the second embodiment will be denoted by the same reference numerals as the reference numerals of the second embodiment, and the description thereof will be omitted.

As illustrated in FIG. 16(A), a serration 17D in the present embodiment includes: a recess 171D which has a true-circular contour; and a protrusion 172D which is formed in the recess 171D.

The recess 171D has the same shape as the shape of the recess 171 described in the second embodiment. The protrusion 172D has a true-circular planar shape. In the present embodiment, a center C of the contour of the recess 171D and a center C' of the protrusion 172D correspond to each other. The center C of the contour of the recess 171D and the center C' of the protrusion 172D may not correspond to each other. The shape of the protrusion 172D in a plan view is not limited to the above-mentioned shape. For example, the shape of the protrusion 172D in a plan view may be an elliptical shape and may be a polygonal shape, such as a rectangular shape.

As illustrated in FIG. 16(B), the protrusion 172D has a height D2 which is substantially equal to a depth D1 of the recess 171D. The protrusion 172D is provided on a bottom surface 171*a* of the recess 171C.

As in the second embodiment, in comparison with a serration including a recessed portion having the same contour as the contour of the serration 17D, the edge portion formed within the contour can be made long in the present embodiment. Accordingly, it is possible to improve reliability in the connection between the crimp terminal 1 and the conductor portion 21 of the wire 2 while an increase in energy required for forming the serration 17D is suppressed.

The embodiments described herein above are presented in order to facilitate understanding of the present invention and are not presented to limit the present invention. Thus, the respective elements disclosed in the above embodiments are intended to cover all design alterations belonging to the technical scope of the present invention and equivalents thereof.

For example, in a plan view, the round shapes 18 (see FIG. 12) described in the modification of the second embodiment may be formed at intersections between the first strip shape 172*a* of the serration 17B described in the third embodiment and the contour of the recess 171B. Likewise, in a plan view, the round shapes 18 may be formed at intersections between the first to third strip shapes 172*a* to 172*c* of the serration 17C and the contour of the recess 171C described in the fourth embodiment, or the round shapes 18 may be formed at central angular portions of the first to third recessed portions 1711 to 1713. In these cases, it is possible to improve the workability of the serrations 17B and 17C.

EXPLANATIONS OF LETTERS OR NUMERALS

1: crimp terminal
11: connecting portion
12: first barrel
13: second barrel
130: inner surface (crimp surface)
131: bottom portion
132: side portion
14: serration

141: linear portion
142: island-shaped portion
143*a* to 143*d*: connected portions
144: edge portion
15: circumscribed circle
17, 17B to 17D: serrations
171, 171B to 171D: recesses
1711 to 1714: first to fourth recessed portions
171*a*: bottom surface
171*b*: side surface
172, 172B to 172D: protrusions
172*a*: first strip shape
172*b*: second strip shape
18: round shape
2: wire
21: conductor portion
22: cover portion
A1 to A6: arcs
E1 to E3: extending directions of first to third strip shapes

The invention claimed is:

1. A crimp terminal comprising a barrel on which a recessed serration is formed, the barrel being to be bent and crimped onto a conductor portion of a wire, wherein
the shape of an outer edge of the serration is formed by at least three outward projections continuing to each other,
wherein each of the at least three outward projections is an arc corresponding to a part of a circle or an arc corresponding to a part of an ellipse,
wherein the recessed serration is a dent disposed on a surface of the barrel.

2. The crimp terminal according to claim 1, wherein
the shape of the outer edge includes a round shape which is formed at a connected portion between adjacent outward projections.

3. The crimp terminal according to claim 1, wherein
a smallest circle which is circumscribed about the shape of the outer edge is a true circle.

4. The crimp terminal according to claim 1, wherein
the number of the outward projections which form the shape of the outer edge is 3, 4, or 6.

5. A crimp terminal comprising a barrel on which a serration is formed, the barrel being to be bent and crimped onto a conductor portion of a wire, wherein
the serration includes:
a recess which has a circular contour in a plan view, the recess being a dent disposed on a surface of the barrel and recessed from the surface of the barrel; and
a protrusion which is provided in the recess, a top of the protrusion being flush with the surface of the barrel or lower than the surface of the barrel with respect to height direction of the protrusion, and
a contour of the protrusion in a plan view is a non-similar figure to the circular contour of the recess in a plan view.

6. The crimp terminal according to claim 5, wherein
the protrusion is connected to the contour of the recess in a plan view.

7. The crimp terminal according to claim 5, wherein
the protrusion includes a strip shape which linearly extends and passes through a center of the recess in a plan view.

8. The crimp terminal according to claim 5, wherein
the protrusion includes first and second strip shapes which linearly extend and are substantially orthogonal to each other at a center of the recess in a plan view,
both end portions of the first strip shape in an extending direction of the first strip shape are connected to the contour of the recess, and
both end portions of the second strip shape in an extending direction of the second strip shape are connected to the contour of the recess.

9. The crimp terminal according to claim 8, wherein
the following Equation (1) is satisfied;

$$\alpha=\beta=45°$$

Here, in the Equation (1), $\alpha$ denotes an angle between an extending direction of the conductor portion and an extending direction of the first strip shape, and $\beta$ denotes an angle between the extending direction of the conductor portion and the extending direction of the second strip shape.

10. The crimp terminal according to claim 8 comprising the barrel on which serrations each of which is the serration are formed, wherein
the serrations are disposed along the extending direction of the first strip shape or the extending direction of the second strip shape.

11. The crimp terminal according to claim 5, wherein
the protrusion includes a strip shape which linearly extends and passes through a center of the recess in a plan view, and
both end portions of the strip shape in an extending direction of the strip shape are connected to the contour of the recess.

12. The crimp terminal according to claim 5, wherein
the protrusion includes first to third strip shapes each of which linearly extends to a center of the recess from the contour of the recess in a plan view,
the first to third strip shapes are connected to each other at the center of the recess, and
the following Equation (2) is satisfied;

$$\gamma=\delta=\varepsilon$$

Here, in the Equation (2), $\gamma$ denotes an angle between an extending direction of the first strip shape and an extending direction of the second strip shape, $\delta$ denotes an angle between the extending direction of the second strip shape and an extending direction of the third strip shape, and $\varepsilon$ denotes an angle between the extending direction of the third strip shape and the extending direction of the first strip shape.

13. The crimp terminal according to claim 6, wherein
a round shape is formed at an intersection between the protrusion and the contour of the recess.

14. The crimp terminal according to claim 8, wherein
a round shape is formed at an intersection between the protrusion and the contour of the recess.

15. The crimp terminal according to claim 11, wherein
a round shape is formed at an intersection between the protrusion and the contour of the recess.

16. The crimp terminal according to claim 12, wherein
a round shape is formed at an intersection between the protrusion and the contour of the recess.

17. The crimp terminal according to claim 1, wherein
each of the at least three outward projections is entirely the arc corresponding to the part of the circle or the arc corresponding to the part of the ellipse.

* * * * *